US007743986B2

(12) United States Patent
Mashimo et al.

(10) Patent No.: US 7,743,986 B2
(45) Date of Patent: Jun. 29, 2010

(54) RECORDING MEDIUM MANAGEMENT SYSTEM AND RECORDING MEDIUM LIQUIDATION APPARATUS

(75) Inventors: Junji Mashimo, Hyogo (JP); Kazumi Yamauchi, Hyogo (JP); Shinji Matsubara, Hyogo (JP); Akihiro Takitani, Hyogo (JP)

(73) Assignee: Glory Ltd., Himeji (JP)

( * ) Notice: Subject to any disclaimer, the term of this patent is extended or adjusted under 35 U.S.C. 154(b) by 973 days.

(21) Appl. No.: 11/488,160

(22) Filed: Jul. 18, 2006

(65) Prior Publication Data

US 2008/0017707 A1 Jan. 24, 2008

(51) Int. Cl.
*G06K 7/08* (2006.01)

(52) U.S. Cl. ..... 235/451; 235/492; 235/375

(58) Field of Classification Search ..... 235/451, 235/492, 380, 375, 381, 487; 463/25
See application file for complete search history.

(56) References Cited

U.S. PATENT DOCUMENTS 6,048,269 A 4/2000 Burns et al.
2004/0254011 A1* 12/2004 Muskin ..... 463/25
2006/0025207 A1* 2/2006 Walker et al. ..... 463/25

FOREIGN PATENT DOCUMENTS

| | | | |
|---|---|---|---|
| JP | 7-505079 | A | 6/1995 |
| JP | 2003-52899 | A | 2/2003 |
| JP | 2003-175152 | A | 6/2003 |
| WO | WO 94/16781 | | 8/1994 |

* cited by examiner

*Primary Examiner*—Edwyn Labaze
(74) *Attorney, Agent, or Firm*—Foley & Lardner LLP

(57) ABSTRACT

A slot machine issues a ticket with a ticket ID; a server manages a remaining amount in to the ticket; a ticket liquidating machine liquidates the ticket by exchanging the ticket for cash. A pouch pay terminal is held by a pouch payer and a cashier terminal is set at a cashier counter. Both the pouch pay terminal and the cashier terminal communicate with the server and can acquire remaining amount in a ticket and perform liquidation of tickets obtained form a player. The persons operating the pouch pay terminal and the cashier terminal take the liquidated tickets to the ticket liquidating machine to get cash they have already paid to the players.

22 Claims, 28 Drawing Sheets

FIG.5

TICKET TERMINAL DATABASE 105

| TICKET ID | ISSUANCE INFORMATION | | | TICKET STATE | |
|---|---|---|---|---|---|
| | DATE AND TIME OF ISSUANCE | MACHINE NUMBER | REMAINING AMOUNT OF TICKET | CLLASIFICATION | LOCATION |
| 1234 | 2006.5.1 11:30 | 1 | 100 $ | ISSUANCE | PLAYER |
| 1235 | 2006.5.1 12:15 | 16 | 120 $ | TICKET LIQUIDATION MACHINE | TICKET LIQUIDATION MACHINE NO. 2 |
| 1236 | 2006.5.1 13:30 | 25 | 150 $ | CASH REGISTER | CASH REGISTER NO. 1 |
| 1237 | 2006.5.1 14:20 | 28 | 200 $ | RECOVERED | OFFICE |
| 1238 | 2006.5.1 15:50 | 36 | 1500 $ | POUCH PAY | NANCY |
| 1239 | 2006.5.1 16:00 | 88 | 300 $ | RECOVERING | JOHN |

FIG.6

CASH MANAGEMENT DATABASE
106

| | CASSETTE ID | CASH TYPE | NUMBER OF CASH |
|---|---|---|---|
| TICKET LIQUIDATION MACHINE | 1234 | 100 | 3000 |
| | 1235 | 20 | 2000 |
| | 1236 | 5 | 2500 |
| | 1237 | 1 | 2500 |

| | EMPLOYEE ID | RESERVE | | | CASH ON HAND | |
|---|---|---|---|---|---|---|
| | | DATE AND TIME OF DISBURSE-MENT | CASH TYPE | NUMBER OF CASH | CASH TYPE | NUMBER OF TYPE |
| POUCH PAY | 5555 | 2006.5.1 10:00 | 100 | 5 | 100 | 3 |
| | | | 20 | 10 | 20 | 5 |
| | | | 5 | 20 | 5 | 10 |
| | | | 1 | 20 | 1 | 10 |

| | CASSETTE ID | CASH TYPE | NUMBER OF CASH |
|---|---|---|---|
| CASH REGISTER | 4321 | 100 | 3000 |
| | 4322 | 20 | 2500 |
| | 4323 | 5 | 2000 |
| | 4324 | 1 | 2000 |

| | CASSETTE ID | CASH TYPE | NUMBER OF CASH |
|---|---|---|---|
| COUNTING MACHINE | 9876 | 100 | 3000 |
| | 9877 | 20 | 2500 |
| | 9876 | 5 | 3000 |
| | 9875 | 1 | 3000 |

RECORDING MEDIUM MANAGEMENT SYSTEM AND RECORDING MEDIUM LIQUIDATION APPARATUS

BACKGROUND OF THE INVENTION

1. Field of the Invention

The present invention relates to a technology for preventing illegal use of recording media that can be used instead of cash.

2. Description of the Related Art

It has become common to set slot machines having a function of issuing a ticket with a barcode printed thereon (hereinafter, "ticket") in amusement shops or gambling shops such as casinos. A player inserts cash in the slot machine and can play games within the amount of the cash. When the player stops playing or hopes liquidation, he presses a dedicated button on the slot machine so that the slot machine ejects a ticket with a value corresponding to the remaining amount assigned thereto.

The player can use the ticket on another slot machine or use the ticket on some other day and play games within the remaining amount. When the player wants to liquidate the ticket, he:

(1) inserts the ticket in a ticket liquidation machine (Refer to U.S. Pat. No. 6,048,269), (2) carries the ticket to a cashier counter and request a person in charge of the cashier counter (hereinafter, "cashier") for liquidation of the ticket, or (3) carries the ticket to a person responsible for pouch pay (hereinafter, "pouch payer") and request the pouch payer for liquidation of the ticket.

FIG. 1 is a schematic of conventional a ticket manage system provided in a casino. A plurality of slot machines 10 are set in the casino and players can play games by inserting cash, such as coins and/or bills, into the slot machines 10. Each slot machine 10 is provided with a liquidation button. When the player presses the liquidation button, the slot machine 10 dispenses a ticket 20 with a value corresponding to remaining amount.

Information concerning the ticket 20 is managed in a ticket management database 50 in a server 40. More specifically, the ticket management database 50 stores therein information such as a ticket ID, a ticket state, and a remaining amount for each ticket output by the slot machines 10. In the example shown in FIG. 1, the ticket state of "unprocessed" for the ticket ID 1111 indicates that the corresponding ticket has not been subjected to liquidation, while the ticket state of "processed" for the ticket ID 1112 indicates that the corresponding ticket has been subjected to liquidation.

When liquidating the ticket 20, the player inserts the ticket 20 into a ticket liquidation machine 60 and performs a prespecified liquidating operation. As a result, the ticket liquidation machine 60 dispenses cash equivalent to the amount in the ticket 20. The player can also liquidate the ticket 20 by carrying the ticket 20 to a cashier counter and requesting the cashier for liquidation. As a result, the cashier pays back cash equivalent to the amount in the ticket 20. The player can also liquidate the ticket 20 by carrying the ticket 20 to a pouch payer and requesting the pouch payer for liquidation. As a result, the pouch payer pays back cash equivalent to the amount in the ticket 20.

The cashier uses a cashier terminal 70, or the pouch payer uses a pouch pay terminal 80 to send information such as the ticket ID to the server 40 and receive information such as the amount remaining in the ticket 20 from the server 40. When the liquidation process is over, the cashier terminal 70 or the pouch pay terminal 80 sends a notice that indicates that the liquidation complete to the server 40. As a result, the ticket state of the ticket 20 in the ticket management database 50 is changed to "processed".

As described above, conventionally, a ticket can be liquidated by using the ticket liquidation machine 60, or by taking the ticket to the cashier or the pouch payer.

However, because the tickets fall in the hands of the cashier or the pouch payer, they can be misused. For example, when the cashier or the pouch payer liquidates a ticket, the liquidated ticket remains in their hands and they can intentionally give that ticket to a malicious third party, or due to their carelessness, that ticket can fall in the hands of the malicious third party. The malicious third party can create a forged ticket by the ticket ID printed on the ticket, by manipulating the barcode that represents the ticket ID, and use the forged ticket to make money.

There is a need of a technology that can prevent illegal use of recording media, such as tickets, that can be used instead of cash.

SUMMARY OF THE INVENTION

It is an object of the present invention to at least partially solve the problems in the conventional technology.

According to an aspect of the present invention, a recording medium management system includes a playing machine that issues a recording medium with a unique recording medium identifying information in response to an operation for issuing the recording medium; a managing unit that manages a remaining amount of a value assigned to each recording medium for each recording medium identifying information; a recording medium liquidation device that receives the recording medium, acquires the recording medium identifying information from the recording medium, sends an inquiry to managing unit concerning a remaining amount of a value assigned to the information for identifying recording medium read from the recording medium, and dispenses cash corresponding to the remaining amount returned from managing unit; a pouch pay terminal device that is carried by a person walking around in a shop and providing a liquidation service for a recording medium to players, acquires recording medium identifying information from a recording medium received from a player, sends an inquiry to managing unit concerning a remaining amount of a value assigned to the recording medium identifying information read from the recording medium, and displays a remaining amount returned from the managing unit; and a cashier terminal device that is provided at a cashier counter providing processing relating to cash for each recording medium with a help by a person in charge for the cashier counter, acquires recording medium identifying information from a recording medium received from a player, sends an inquiry to the managing unit concerning a remaining amount of a value assigned to the recording medium identifying information read from the recording medium, and displays a remaining amount returned from the managing unit. The managing unit includes a recording medium management database that manages a state of a liquidated recording medium having been subjected to liquidation by at one of the recording medium liquidation device, the pouch pay terminal device, and the cashier terminal device as well as a recording medium not having been subjected to liquidation for each recording medium identifying information; and a state updating unit that updates a state of each recording medium managed in the recording medium management database based on recording medium identifying information received from any one of the playing machine, the recording medium liquidation device, the pouch pay terminal device, and the cashier terminal device.

According to another aspect of the present invention, a recording medium liquidation device includes a reading unit that reads, when receiving a recording medium issued from a playing machine and used for management of a remaining amount stored therein by a managing unit, recording medium identifying information in the recording medium; a remaining amount inquiring unit that sends an inquiry concerning a remaining amount correlated to the identifying information read by the reading unit to the managing unit; a liquidating unit that performs liquidation by dispensing cash corresponding to a remaining amount returned from the managing unit in response to the inquiry from the remaining amount inquiring unit; and a reserve disbursing unit that disburses reserve to be delivered to a person walking around in a ship and performing a liquidation service for a recording medium to a player.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 5 is an example of the contents of a ticket management database shown in FIG. 4;

FIG. 6 is an example of the contents of a cash management database shown in FIG. 4;

DETAILED DESCRIPTION OF THE PREFERRED EMBODIMENTS

Exemplary embodiments of the present invention will be explained below with reference to accompanying drawings. The present invention is not to be limited by following embodiments.

Figure 1:
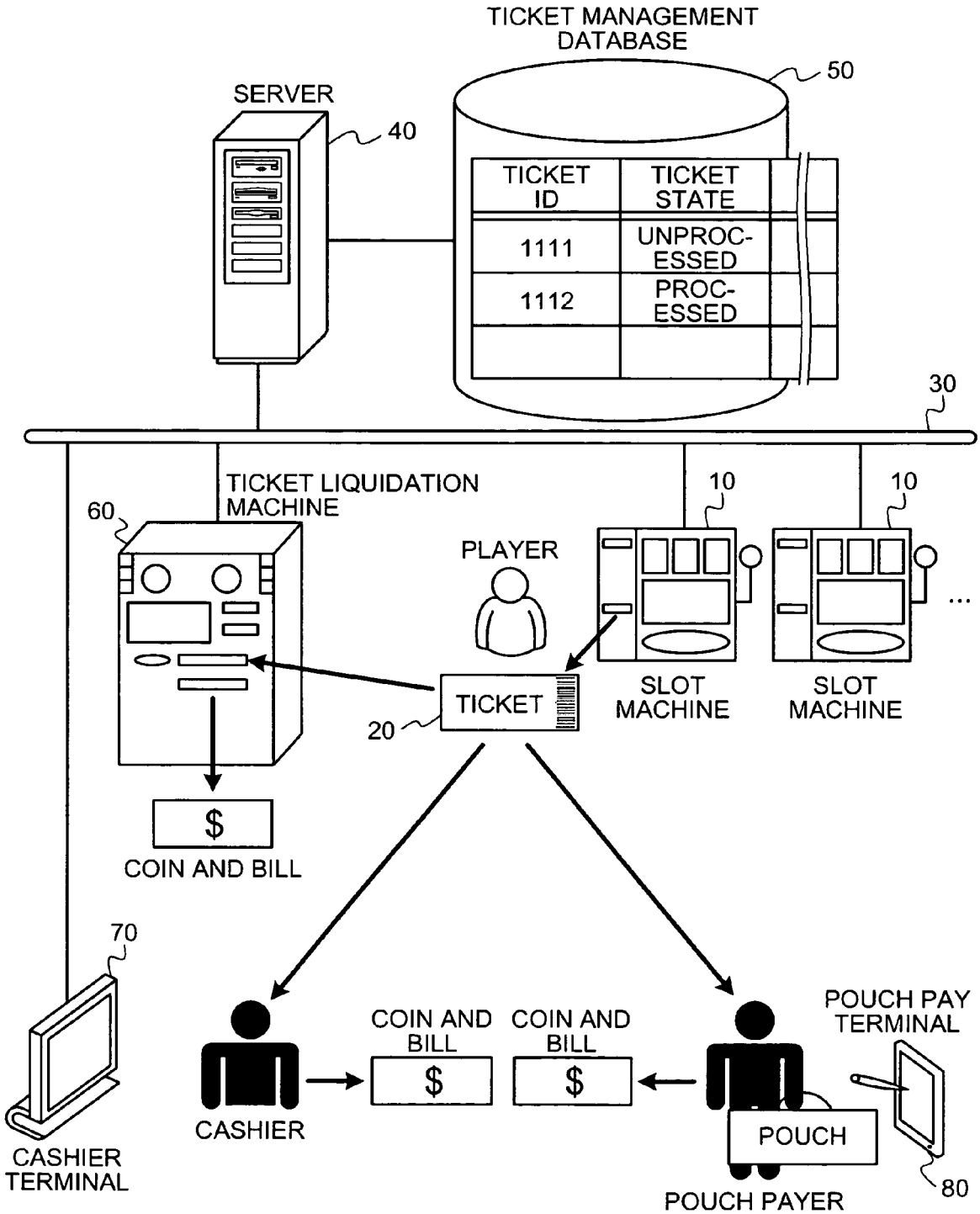
FIG. 1 is a schematic of a conventional ticket management system provided at casinos.
Figure 2:
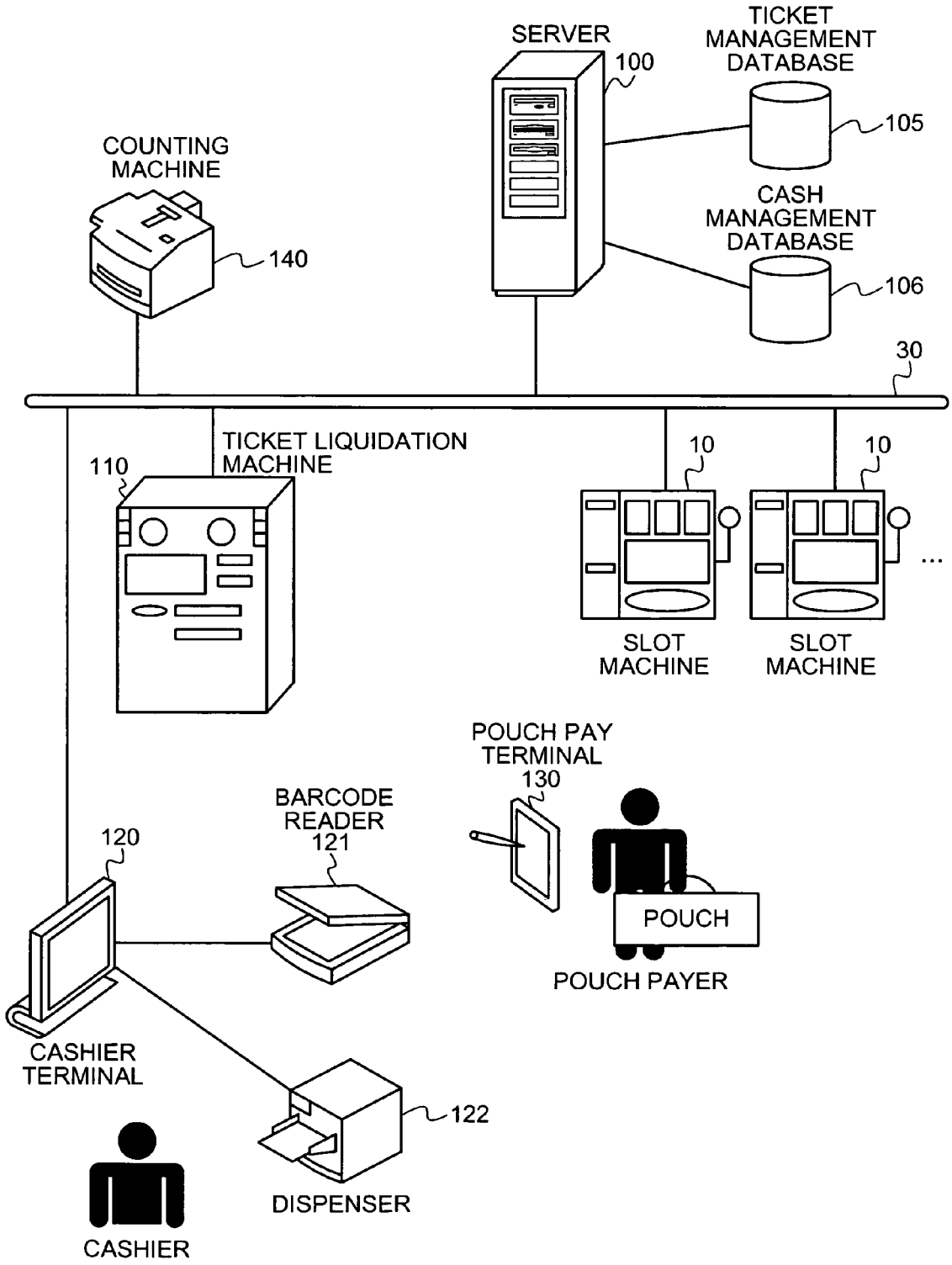
FIG. 2 is a schematic of a ticket management system according to a first embodiment of the present invention.

FIG. 2 is a schematic of a ticket management system according to a first embodiment of the present invention. The ticket management system includes a plurality of the slot machines 10, a server 100, a ticket liquidation machine 110, a cashier terminal 120, a pouch pay terminal 130, and a counting machine 140.

The slot machine 10 is for playing a slot game. A player can play game at the slot machine 10 by inserting cash or a ticket in the slot machine 10. When cash is inserted, the slot machine 10 temporarily records the total amount of the inserted cash, and allows the player to play slot games within that amount. Each of the slot machines 10 is provided with a play-canceling button (not shown). When the player pushes the play-canceling button while the remaining amount is still larger than 0, the slot machine 10 issues a ticket. A barcode that indicates a ticket ID is printed on the ticket. The remaining amount of the issued ticket is managed by the server 100.

The server 100 manages a ticket state of each ticket and cash in each of the devices in the casino. Specifically, the server 100 includes a ticket management database 105 that manages the ticket state, and a cash management database 106 that manages the cash in each of the devices in the casino.

Namely, the server 100 manages not only the ticket states of "processed" (i.e., liquidation over) and "unprocessed" (i.e., liquidation not over), but also manages whether the ticket issued by the slot machine 10 is recovered and where the ticket is. As a result, the server 100 enables countermeasures to be taken, promptly and effectively, against illegal use of forged tickets.

The ticket liquidation machine 110 dispenses cash corresponding to the remaining amount of a ticket when the ticket is inserted in the ticket liquidation machine 110. A player himself (i.e., primary liquidation), or a pouch payer (i.e., secondary liquidation) can perform liquidation of a ticket with the ticket liquidation machine 110.

When the pouch payer is to perform the liquidation of the ticket, the player handovers his ticket to the pouch payer. The pouch payer then accesses the server 100 through the pouch pay terminal 130 based on the ticket ID printed on the ticket, obtains the remaining amount of the ticket, and dispenses cash corresponding to the remaining amount to the player. Then, the pouch payer walks to the ticket liquidation machine 110 and exchanges the liquidated ticket received from the player for cash. In other words, the pouch payer inserts the ticket in the ticket liquidation machine 110 so that the ticket liquidation machine 110 performs a liquidation process (secondary liquidation process) and returns cash to the pouch payer, which the pouch payer has already paid to the player. As a result, liquidated tickets conventionally kept by the pouch payer are collected in the ticket liquidation machine 110, which helps to prevent illegal use of the liquidated ticket.

In the ticket liquidation machine 110, tickets are collected in a ticket cassette (not shown). When a ticket cassette gets full of tickets, it is recovered by an employee. The tickets in the cassette are counted with the counting machine 140 and thereby managed. The ticket liquidation machine 110 can perform money exchanging process of exchanging bills for bills, bills for coins, and coins for bills.

The cashier terminal 120 is set at a cashier counter and operated by a cashier. A barcode reader 121 and a dispenser 122 are connected to the cashier terminal 120.

When the cashier at the cashier counter receives a ticket from a player, he reads a barcode printed on the ticket with the barcode reader 121, obtains a remaining amount of the ticket by sending an inquiry to the server 100 with a ticket ID read from the barcode, and performs a liquidation process (primary liquidation process) of dispensing cash corresponding to the remaining amount of the ticket from the dispenser 122. Similar to the ticket liquidation machine 110, the cashier terminal 120 can handle the primary liquidation by the player as well as the secondary liquidation of the liquidated ticket by the pouch payer.

The pouch pay terminal 130 is carried by a pouch payer who is walking around the shop to liquidate tickets presented by players. The pouch pay terminal 130 is configured to perform wired or wireless communications with the server 100.

When a pouch player receives a ticket from a player, he reads a barcode printed on the ticket using the barcode reader (not shown) of the pouch pay terminal 130, sends a notice of a ticket ID read from the barcode to the server 100, obtains a remaining amount of the ticket, and pays cash corresponding to the remaining amount of the ticket.

As described above, the pouch payer can perform secondary liquidation of the liquidated ticket via the ticket liquidation machine 110 or at the cashier counter. It is preferable that pouch payers do not carry many liquidated tickets, in other words, it is preferable that the pouch payers frequently perform the secondary liquidation so that the liquidated tickets are collected in the ticket liquidation machine 110 or at the cashier counter with little time lag. Such an arrangement makes the pouch payers difficult to illegally use a liquidated ticket.

The counting machine 140 counts and classifies bills and tickets recovered from the ticket liquidation machine 110, the slot machine 10, and the cashier counter in batch. The counting machine 140 can also retrieve a target ticket when a ticket ID of the target ticket is registered beforehand. An employee in the casino may regularly walk to the ticket liquidation machine 110, deliver the ticket cassette and the cash cassette in the ticket liquidation machine 110 to the counting machine 140, and count the number of tickets or cash in the cassettes.

Figure 3:
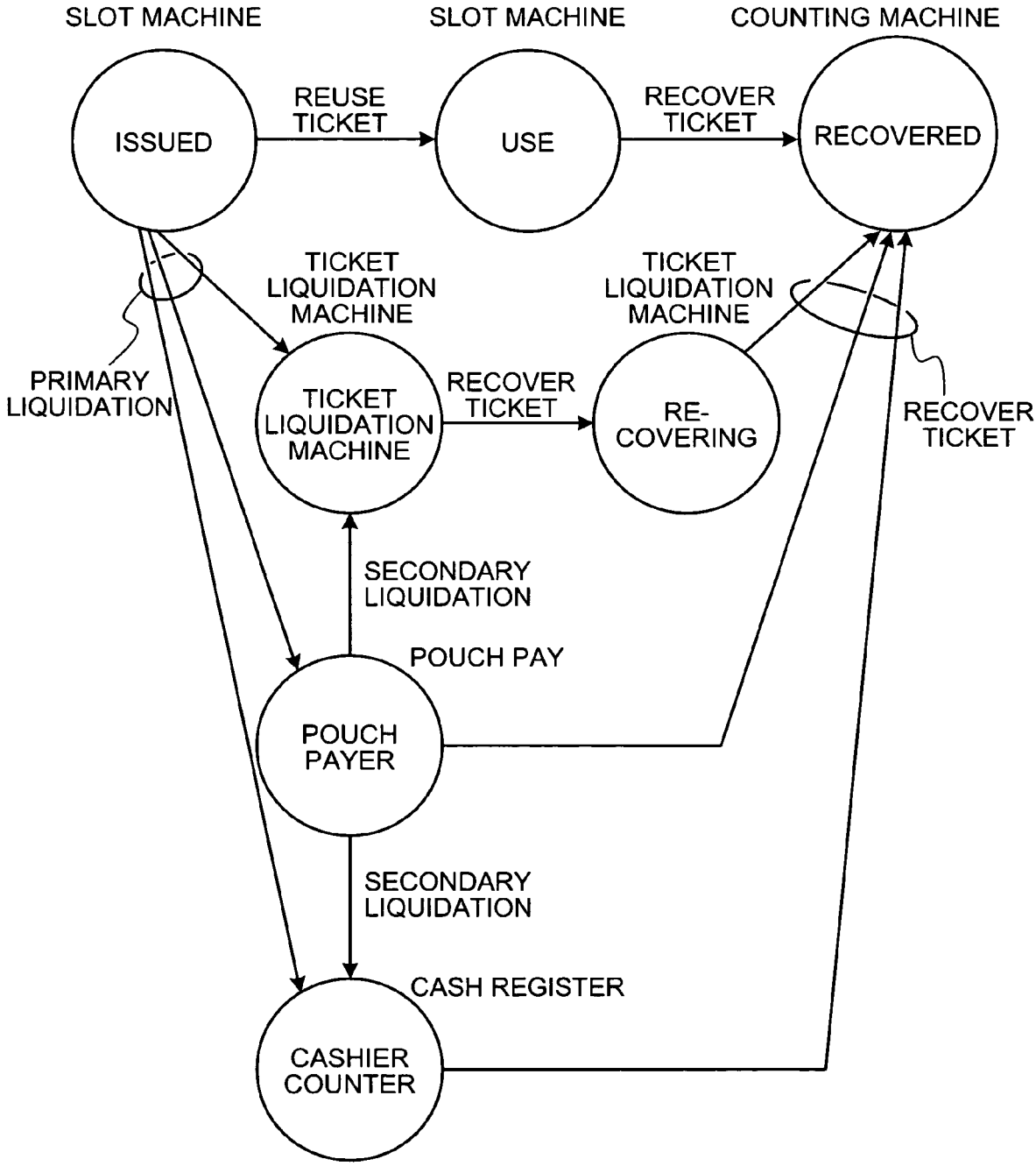
FIG. 3 is a schematic for explaining ticket states according to the first embodiment.

The server 100 manages a state of tickets (hereinafter, "ticket state") in the ticket management database 105. FIG. 3 is a schematic for explaining ticket states managed by the server 100 in the ticket management database 105.

A ticket can have any one of following 7 states:

"issued" indicating that the ticket is issued,

"use" indicating that the issued that ticket is being reused,

"ticket liquidation machine" indicating that the ticket is in the ticket liquidation machine 110, "recovering" indicating that the ticket in the ticket cassette of the ticket liquidation machine 110 is being recovered, "pouch payer" indicating that the ticket is with a pouch payer, "cashier counter" indicating that the ticket is with the cashier, and "recovered" indicating that the ticket has been recovered in the counting machine 140.

When the slot machine 10 issues a ticket to a player, it sends a notice to the server 100 that it has issued a ticket so that the ticket management database 105 registers the information assigned to the ticket such as a ticket ID, issuance information, and a ticket state of "issued". The player keeps the issued ticket.

The player can play another game at the same slot machine at a different time or play a game at different slot machine by reusing the issued ticket. In such a case, when the player inserts the ticket in a different slot machine, a notice is sent to the server 100 that the ticket is being reused, and then the ticket state is updated from "issued" to "use". Also, the ticket management database 105 records a machine number of the slot machine 10 on which the player is using the ticket.

Once the amount in the ticket is exhausted, that ticket is collected in the slot machine 10. An employee of the casino recovers tickets from each slot machine 10 and puts the recovered tickets in the counting machine 140 for counting. The counting machine 140 counts the tickets and sends the ticket ID of those tickets to the server 100. As a result, the server 100 updates the ticket state of those tickets from "use" to "recovered". The location information of the ticket is recorded as "office" on the ticket management database 105, because the counting machine 140 is provided at the office.

A player with the issued ticket can play another game or can liquidate the ticket for the remaining amount (primary liquidation). When the player performs a prespecified liquidation operation by inserting the ticket in the ticket liquidation 110, the ticket ID of the ticket is sent to the server 100 to update the ticket state of the ticket from "issued" to "ticket liquidation machine". When an employee recovers the ticket in the ticket liquidation machine 110, the ticket ID is sent to the server 100 and the ticket state is updated from "ticket liquidation machine" to "recovering".

A player can also liquidate the ticket without using the ticket liquidation machine 110. When the player requests a pouch payer to liquidate the ticket, the pouch pay terminal 130 sends the ticket ID of the ticket to the server 100 and the ticket state is updated from "issued" to "pouch payer".

The liquidated ticket carried by the pouch payer can be performed secondary liquidation either operated by the ticket liquidation machine 110 or through the cashier counter with the help of another employee. In the conventional system, the secondary liquidation cannot be performed except through the cashier counter. In this embodiment of the present invention, however, the pouch payer can also perform secondary liquidation of the ticket having being subjected to the primary liquidation by the ticket liquidation machine 110.

When the ticket having being subjected to the primary liquidation carried by the pouch payer is inserted in the ticket liquidation machine 110 for the secondary liquidation, the ticket ID of the ticket is sent from the ticket liquidation machine 110 to the server 100 and the ticket state is updated from "pouch payer" to "ticket liquidation machine". In the normal mode for liquidation by the prayer, the ticket liquidation machine 110 cannot perform the secondary liquidation. To perform the secondary liquidation, a prespecified operation such as that performed by the pouch payer inserting an employee card to the ticket liquidation machine 110 is required. This is because secondary liquidation without qualification will help to increase illegal use of the liquidated ticket.

Similarly, when the pouch payer transfers the ticket having being subjected to the primary liquidation to the cashier for secondary liquidation, the cashier terminal 120 sends the ticket ID of the ticket to the server 100 and the ticket state is updated from "pouch payer" to "cashier counter".

When the player requests the cashier to liquidate the ticket, the cashier terminal 120 sends the ticket ID of the ticket to the server 100 and the ticket state is updated from "issued" to "cashier counter".

When the liquidated ticket kept in the cashier counter or the liquidated ticket kept by the pouch payer is recovered and is put in the counting machine 140, the ticket state of the ticket is updated from "cashier counter" or "pouch payer" to "recovered".

In this embodiment, as described above, information concerning (1) location where the ticket is liquidated, (2) location where the ticket is, and (3) whether the ticket is recovered is managed at all time by the server 100 instead of 2 types of information of "performed" and "unperformed" in the conventional system, which realizes traceability of the ticket. Therefore, when a ticket with a certain ticket ID may be used illegally, the system can promptly and effectively identify where the ticket is.

Figure 4:
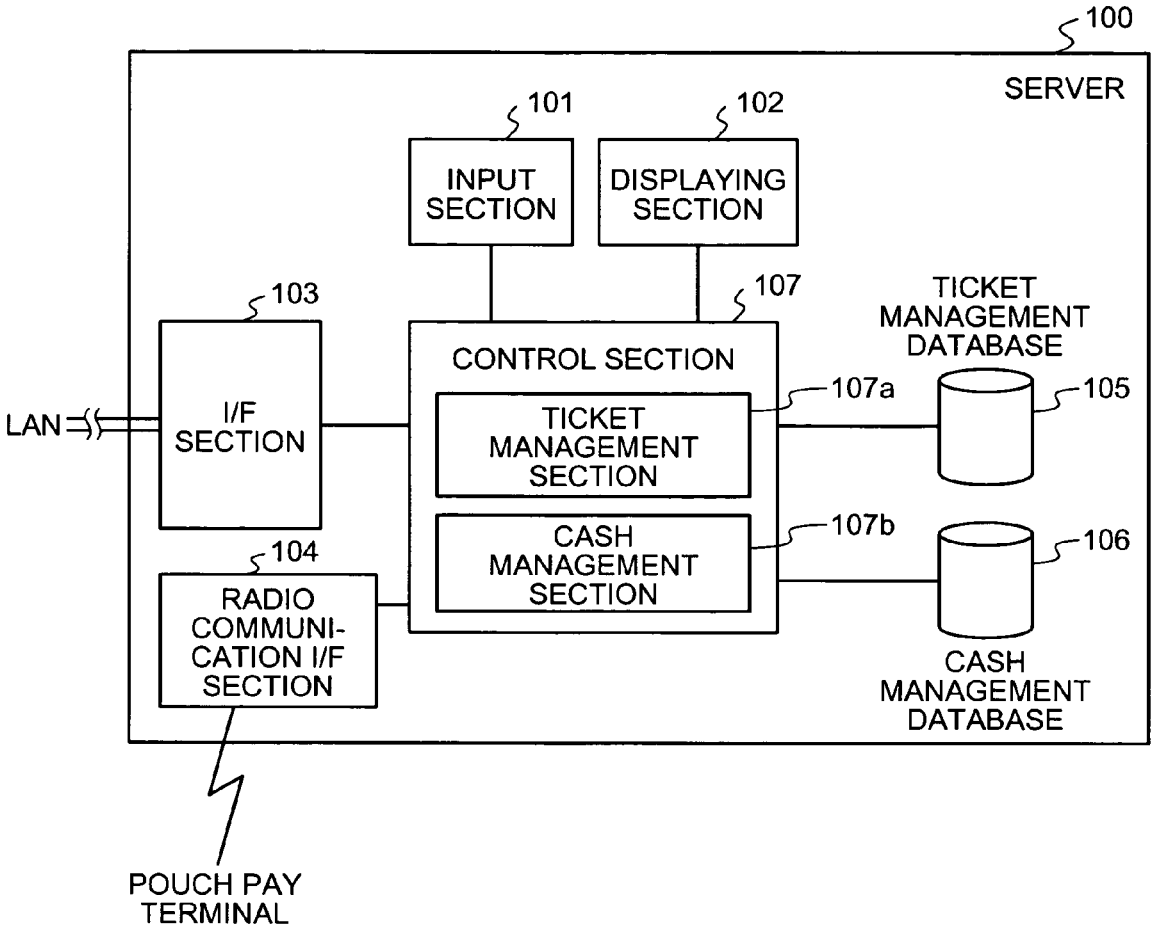
FIG. 4 is a detailed functional block diagram of a server shown in FIG. 2.

A configuration of the server 100 is described below. FIG. 4 is a functional block diagram of the server 100. The server 100 includes an input section 101, a displaying section 102, an I/F section 103, a radio communication I/F section 104, the ticket management database 105, the cash management database 106, and a control section 107.

The input section 101 is an input device such as a mouse or a keyboard; the displaying section 102 is a displaying device such as a liquid crystal panel or a display. The input section 101 and the displaying section 102 are used when a manager boots the server 100 or makes various settings.

The I/F section 103 is an interface for communicating data via a LAN 30 with the slot machine 10, the ticket liquidation machine 110, and the cashier terminal 120. The radio communication I/F section 104 is an interface for wireless communication with the pouch pay terminal 130.

The ticket management database 105 records issuance information and a ticket state of ticket for each ticket ID. FIG. 5 is an example of the contents of the ticket management database 105. The issuance information includes date and time of the ticket being issued, a machine number of the slot machine issuing the ticket, and a remaining amount of the ticket. The ticket state includes a classification of a state and a location of the ticket. Namely, a ticket with a ticket ID of "1234" is issued by a slot machine with a machine number of "1" on "May 1, 2006" at "11:30". A remaining amount of the ticket is "100$" and the ticket state is "issued" indicating that the ticket is possessed by the player.

Similarly, a ticket with a ticket ID of "1235" is in a ticket liquidation machine with a machine number of "2", and a ticket with a ticket ID of "1236" is in a cashier counter with a machine number of "1". While in FIG. 2 there is provided one ticket liquidation machine 110 and one cashier counter, in FIG. 5, it is assumed that a plurality of ticket liquidation machines 110 and cashier counters are provided.

The cash management database 106 manages cash amount in the ticket liquidation machine 110, in the counting machine 140, in the cashier counter, and in the pouch pay. FIG. 6 is an example of the contents of the cash management database 106. All of the ticket liquidation machine 110, the counting machine 140, and the dispenser 122 at the cashier counter manage cash using a cash cassette, so that the type of coins and bills and the number of coins and bills are managed for each cassette with each cassette ID.

The pouch payer prepares reserve within a pouch from the ticket liquidation machine 110. Therefore, the pouch payer should manage date and time of disbursement from the reserve and the number of coins and bills for each type of cash in the reserve as well as cash on hand by managing the number of coins and bills for each type of cash.

The control section 107 generally controls the server 100 and includes a ticket management section 107*a* and a cash management section 107*b*. Practically, the CPU loads and executes, from ROM or the like, a program corresponding to the ticket management section 107*a* and the cash management section 107*b* to boot a process corresponding to the ticket management section 107*a* and the cash management section 107*b*.

The ticket management section 107*a* manages a ticket state for each issued ticket with the ticket management database 105. As described above with reference to FIG. 3, when the slot machine 10 sends a new issuance request of a ticket, the ticket management section 107*a* generates a ticket ID of the ticket, makes a new field for the lately registered ticket ID on the ticket management database 105, and records a ticket state of the ticket as "issued".

When the ticket management section 107*a* receives a notice of the ticket ID from the slot machine 10, the ticket management section 107*a* checks a ticket state by referring to the ticket management database 105. When the ticket state is "issued", the ticket management section 107*a* updates the ticket state to "use". When the ticket management section 107*a* receives the notice of ticket ID from the counting machine 140, the ticket management section 107*a* updates the ticket state to "recovered".

Also, when the ticket management section 107*a* receives a notice of the ticket ID from the ticket liquidation machine 110, the ticket management section 107*a* checks a ticket state by referring to the ticket management database 105. When the ticket state is "issued" or "pouch payer", the ticket management section 107*a* updates the ticket state to "ticket liquidation machine". While, when the ticket state is "ticket liquidation machine", the ticket management section 107*a* updates the ticket state to "recovered".

Furthermore, when the ticket management section 107*a* receives a notice of the ticket ID from the pouch pay terminal 130, the ticket management section 107*a* checks a ticket state by referring to the ticket management database 105. When the ticket state is "issued", the ticket management section 107*a* updates the ticket state to "pouch payer". When the ticket management section 107*a* receives a notice of the ticket ID from the cashier terminal 120, the ticket management section 107*a* checks a ticket state by referring to the ticket management database 105. When the ticket state is "issued" or "pouch payer", the ticket management section 107*a* updates the ticket state to "cashier counter".

The cash management section 107*b* manages, with the cash management database 106, cash amount on hand in the ticket liquidation machine 110, the counting machine 140, the cashier counter, and the pouch pay. In particular, when the cash cassette with cash included therein is provided in the ticket liquidation 110, the cash management section 107*b* receives a cassette ID for each cash cassette from the ticket liquidation machine 110 and records the cassette ID and the number of coins and bills should be predetermined.

Whenever the ticket liquidation is performed, the cash management database 106 is updated depending on the situation disbursed for the ticket liquidation. A similar updating operation is performed when the cash management database 106 receives the cassette ID from the cashier terminal 120 or the counting machine 140.

When the pouch payer disburses the reserve from the ticket liquidation machine 110, the date and time of disbursement from the reserve and the number of coins and bills for each type of cash are recorded. The current cash amount in pouch pay is managed with the cash management database 106.

The control section 107 can include an illegality detecting section (not shown) that checks for any illegality, and a reporting control section (not shown) that reports using a sound or by displaying a sign, when any illegality is detected by the illegality detecting section, the fact that the illegality has been found. A suspect case of suspected illegality is, for instance, where a ticket ID sent from the ticket liquidation machine 110 is not recorded in the ticket management database 105, or where a ticket ID sent from the ticket liquidation machine 110 has already been recovered.

Such a case shows the high possibility of illegality, so that the illegality detecting section checks for any illegality when it happens.

Figure 7:
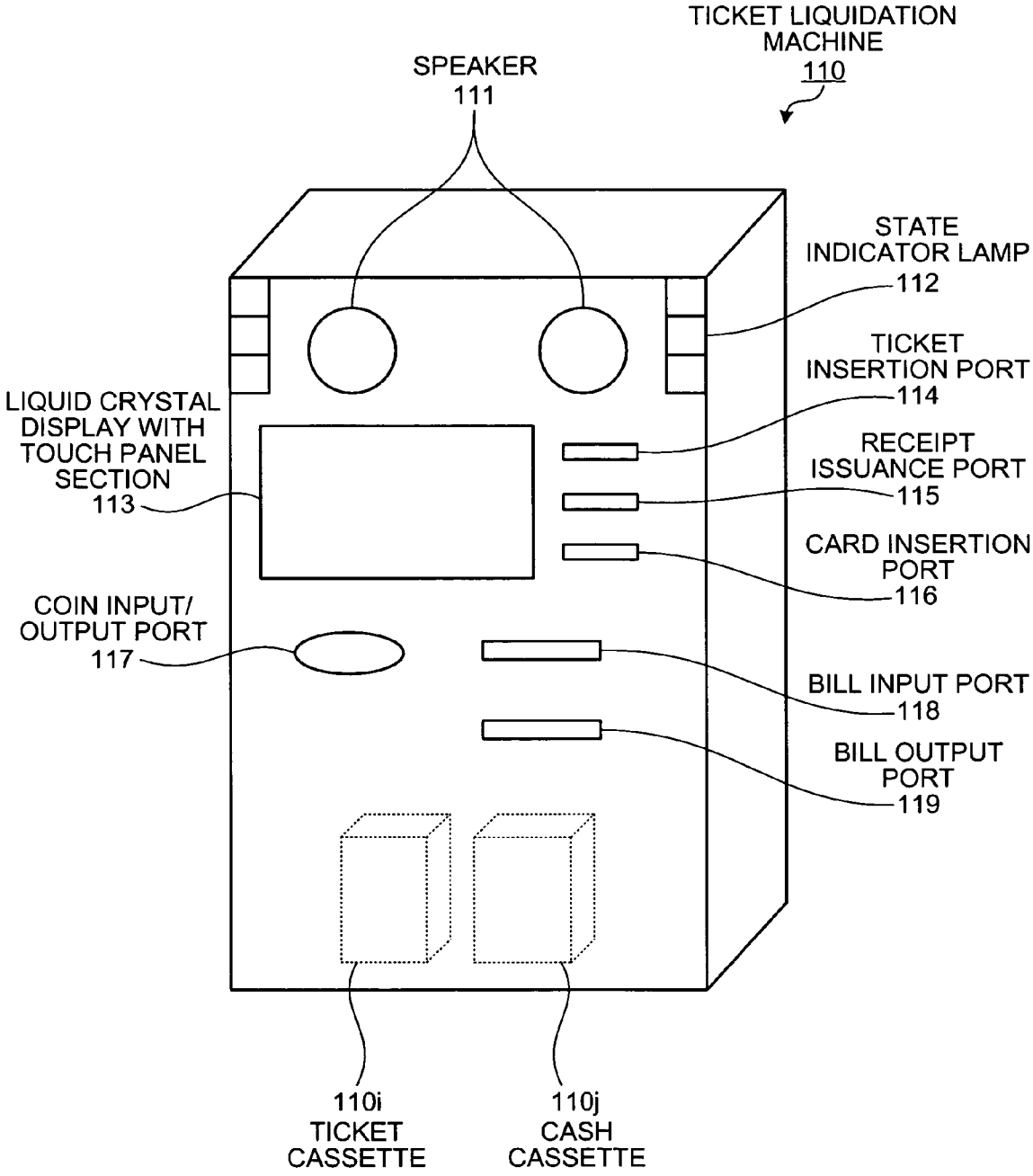
FIG. 7 is an external perspective of a ticket liquidation machine shown in FIG. 2.

The configuration of the ticket liquidation machine 110 is described below. FIG. 7 is an external perspective of the ticket liquidation machine 110. As shown in FIG. 7, the ticket liquidation machine 110 includes, at a front face, a speaker 111, a state indicator lamp 112, a liquid crystal display with touch panel section 113, a ticket insertion port 114, a receipt issuance port 115, a card insertion port 116, a coin input/output port 117, a bill input port 118, and a bill output port 119. Inside of the ticket liquidation machine 110, there are a ticket cassette 110*i* for storing liquidated tickets and a cash cassette 110*j* for storing coins and bills.

When a player performs ticket liquidation, the player inserts the ticket into the ticket insertion port 114. The ticket liquidation machine 110 receives the ticket from the ticket insertion port 114, reads a ticket ID of the ticket, sends the ticket ID to the server 100, obtains a remaining amount of the ticket, and displays the remaining amount on the liquid crystal display with touch panel section 113. When the player pushes a liquidation button displayed on the liquid crystal display with touch panel section 113, cash corresponding to the remaining amount of the ticket is dispensed from the bill output port 119 and the coin input/output port 117.

Figure 8:
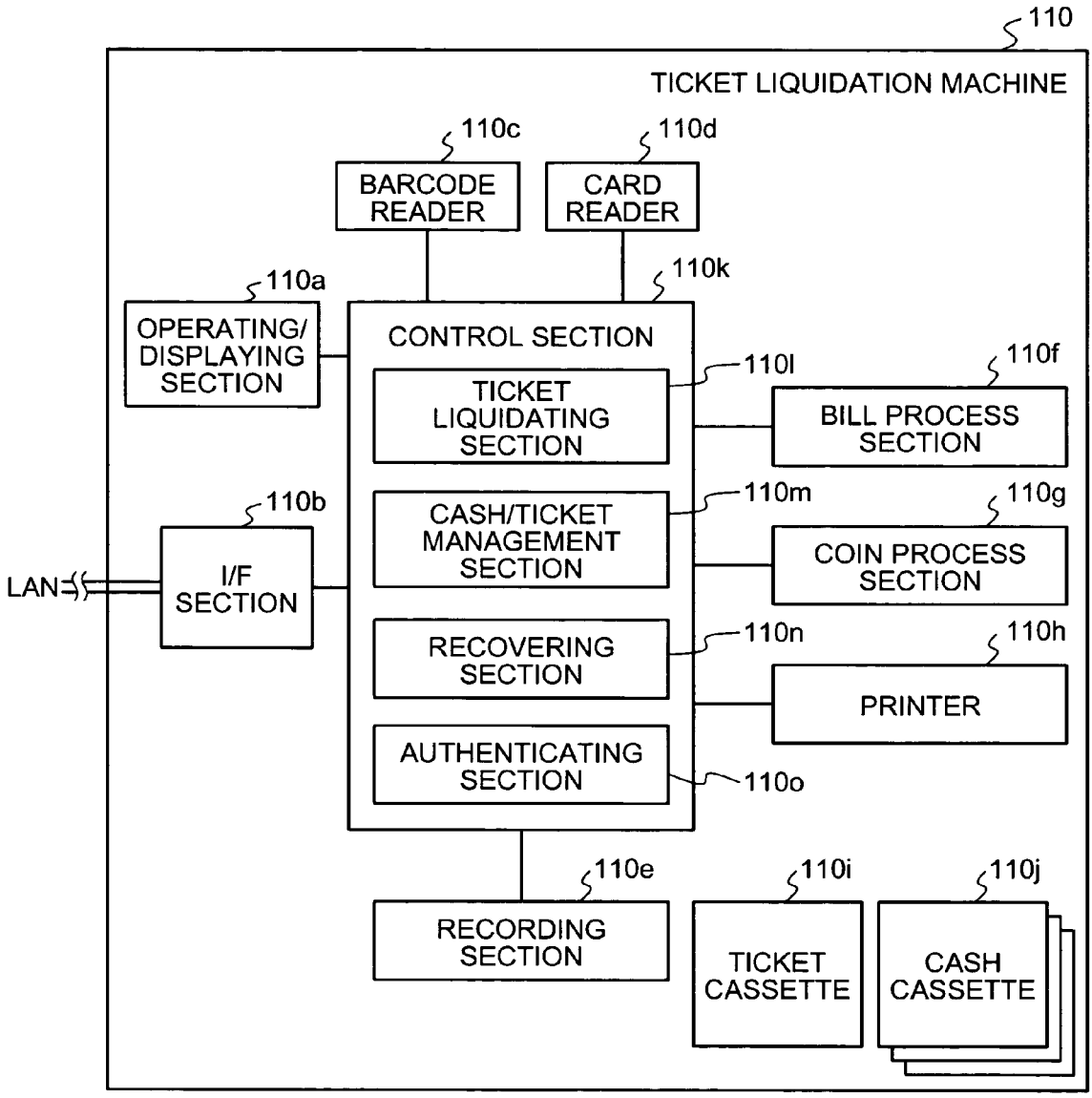
FIG. 8 is a detailed functional block diagram of the ticket liquidation machine shown in FIG. 2.

An inner configuration of the ticket liquidation machine 110 is described below. FIG. 8 is a detailed functional block diagram of the ticket liquidation machine 110. The ticket liquidation machine 110 includes an operating/displaying section 110*a*, an I/F section 110*b*, a barcode reader 110*c*, a card reader 110*d*, a recording section 110*e*, a bill process section 110*f*, a coin process section 110*g*, a printer 110*h*, the ticket cassette 110*i*, the cash cassette 110*j* and a control section 110*k*.

The operating/displaying section 110*a* controls devices belonging to an operating system or a displaying system. In particular, the operating/displaying section 110*a* performs sound control output from the speaker 111, display control on the state indicator lamp 112, and input data receiving from and display control on the liquid crystal display with touch panel section 113. The I/F section 110*b* is an interface section for communicating data with the server 100 via the LAN 30.

The barcode reader 110*c* reads a barcode printed on the ticket inserted into the ticket insertion port 114 and is provided on a delivery route through which the ticket is delivered. The card reader 110*d* reads information such as an employee number from a magnetic stripe printed on an employee card inserted from the card insertion port 116. The recording section 110*e* is a recording device such as a Random Access Memory (RAM) for temporally recording data.

The bill process section 110*f* identifies a bill type, examines the bill to check whether the bill is legitimate or counterfeited, and controls bill delivery. The coin process section 110*g* identifies coin types, examines the coin to check whether the coin is legitimate or counterfeited, and controls coin delivery. When receiving bills or coins input from the bill input port 118 or the coin input/output port, the bill process section 110*f* and the coin process section 110*g* identify the types of coin and bill and examine whether the bill or coin is legitimate or counterfeited. In a case where the bill or coin is legitimate, the bill or coin is delivered to the cash cassette 110*j*. When performing the ticket liquidation process, the bill process section 110*f* and the coin process section 110*g* deliver the bills or coins corresponding to the remaining amount of the ticket from the cash cassette 110*j* to the bill output port 119 or the coin input/output port 117.

The printer 110*h* is used for issuing a receipt or the like at the ticket liquidation. The ticket cassette 110*i* is for storing the liquidated ticket, and the cash cassette 110*j* is for storing cash. The cash cassette 110*j* is prepared for each type of cash.

The control section 110*k* generally controls the ticket liquidation machine 110 and has a ticket liquidating section 110*l*, a cash/ticket management section 110*m*, a recovering section 110*n*, and an authenticating section 110*o*. The control section 110*k* practically load, on the CPU, programs corresponding to the ticket liquidating section 110*l*, the cash/ticket management section 110*m*, the recovering section 110*n*, and the authenticating section 110*o* and executes the program corresponding to each functional section to perform processes.

The ticket liquidating section 110*l* performs a primary liquidation process for liquidating a ticket with a ticket state of "issued" and a secondary liquidation process for liquidating a ticket with a ticket state of "pouch payer". When the ticket liquidating section 110*l* receives a ticket inserted from the ticket insertion port 114, the barcode reader 110*c* reads a barcode printed on the ticket to obtain a ticket ID. The ticket liquidating section 110*l* queries a remaining amount of the ticket by sending the ticket ID to the server 100 and performs the process in which cash corresponding to the remaining amount of the ticket received from the server 100 is output. To perform the secondary liquidation process, such conditions are required that a result of authentication by the authenticating section 110*o* is true and the liquidation machine is switching to the employee mode.

The cash/ticket management section 110*m* controls an amount of cash within the cash cassette 110*j* and each ticket ID stored within the ticket cassette 110*i*. For management of cash, in particular, to manage a type and number of cash currently stored therein, the cash/ticket management section 110*m* sends an inquiry concerning the type and number of cash stored in the cash cassette 110*j* to the server 100 when the cash cassette 110*j* is provided therein, and subtracts disbursement type and number whenever a disbursement occurs. The cash/ticket management section 110*m* also manages the ticket ID of liquidated ticket when the ticket liquidation process is performed.

The recovering section 110*n* supports recovery processing of the cash cassette 110*j* and the ticket cassette 110*i* performed by an employee. In particular, after receiving a ticket recovering instruction by the employee, the recovering section 110*n* extracts a ticket ID of a ticket stored therein and sends a notice of the ticket ID to the server 100.

The authenticating section 110*o* authenticates an employee through the server 100. In particular, after receiving an employee card from the card insertion port 116 and a security code through a numeric keypad on the liquid crystal display with touch panel section 113, the authenticating section 110*o* sends an authentication request with the employee ID and the security code read from the employee card to the server 100. Whether the employee is true or not is determined based on a returned result. When the authentication result of the employee card is true, the authenticating section 110*o* switches from the normal mode to an employee mode for enabling disbursement of reserve to the pouch payer and secondary liquidation by the pouch payer.

Figure 9:
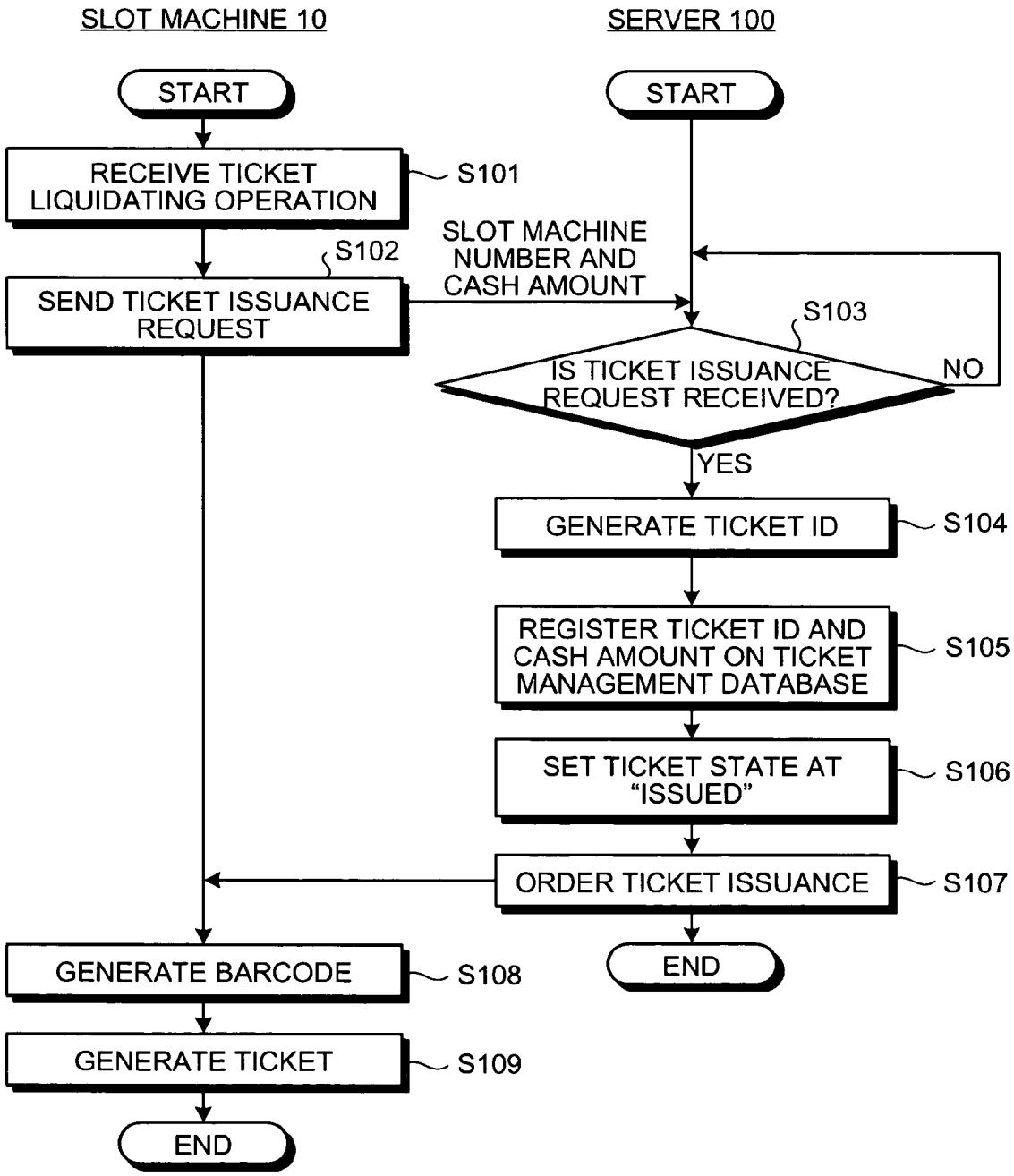
FIG. 9 is a flowchart of a ticket generating procedure performed by a slot machine and the server shown in FIG. 2.

Ticket generating procedure by the slot machine 10 is described below. FIG. 9 is a flowchart of the ticket generating process by the slot machine 10. When a player performs a ticket issuance operation with the slot machine 10 and the slot machine 10 receives the ticket issuance operation (Step S101), the ticket issuance request is sent to the server 100 (Step S102). The ticket issuance operation practically means an operation performed the player by pushing down a play-canceling button provided at the slot machine 10. The ticket issuance request includes information of a machine number of the slot machine 10 and an amount of cash kept on the slot machine 10. When the player inserts a large bill in the slot machine 10, the slot machine 10 keeps the bill therein, so that the player can play games again and again within a remaining amount.

The server 100, after receiving the ticket issuance request (YES at Step S103), generates the ticket ID (Step S104) and registers the ticket ID, the cash amount received from the slot machine 10, and date and time of issuance of the ticket on the ticket management database 105 (Step S105). In the example shown in FIG. 5, data such as the ticket ID of "1234", the date and time of ticket to be issued "11:30", the slot machine number of "1", and the cash amount (remaining amount of the ticket) of "$100" are registered, each connected with each other.

After Step S105, the server 100 sets a classification of the ticket state at "issued" (Step S106). In the example shown in FIG. 5, information assigned to the ticket ID "1234" shows that the ticket state is set at "issued" for classification and at "player" for location. The server 100 sends a ticket issuance instruction to the slot machine 10 that sends the ticket issuance request (Step S107), because the slot machine 10 itself issues the ticket. The ticket issuance instruction at least includes the ticket ID.

The slot machine 10 that receives the ticket issuance instruction generates a barcode corresponding to the ticket ID (Step S108) and issues a ticket with the barcode generated at the prior step printed thereon (Step S109).

Figure 10:
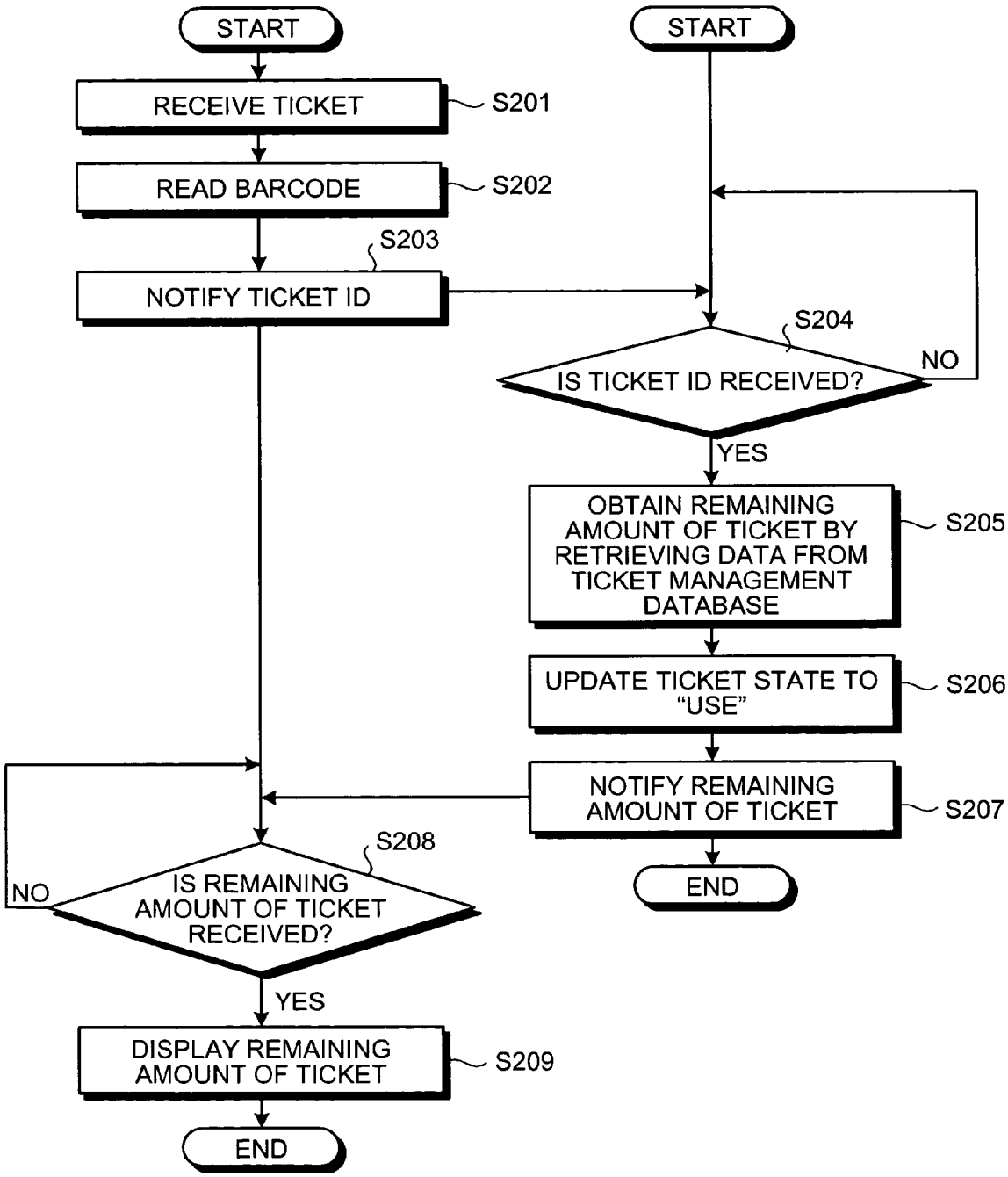
FIG. 10 is a flowchart of a ticket accepting procedure performed by a slot machine that did not issue the ticket.

A processing procedure is described below where the issued ticket is used again at a slot machine 10 other than the slot machine which issues the ticket. FIG. 10 is a flowchart of a ticket accepting procedure where the issued ticket is used again at a slot machine 10 other than the slot machine which issues the ticket.

As shown in FIG. 10, after the slot machine 10 receives the ticket (Step S201), the slot machine 10 reads a barcode printed on the ticket (Step S202), obtains a ticket ID from the barcode, and sends a notice of the obtained ticket ID along with the machine number of the slot machine 10 to the server 100 (Step S203).

When the server 100 receives the notice of the ticket ID (YES at Step S204), the server 100 obtains a remaining amount assigned to the ticket ID by retrieving data assigned to the ticket ID from the ticket management database 105 (Step S205), and updates the classification of the ticket state of the ticket ID to "use" (Step S206). Similarly, although detailed description is omitted due to simplification, the location of the ticket state is the machine number of the slot machine 10 to be used. Then the server 100 sends a notice of a remaining amount assigned to the ticket ID to the slot machine 10 (Step S207).

After the slot machine 10 receives the remaining amount of the ticket from the server 100 (YES at Step S208), the slot machine 10 displays the remaining amount of the ticket (Step S209) and turns on a playable state with the remaining amount of the ticket kept therein.

Detail description of receiving the ticket issuance operation under the condition that the player stops a game after the ticket is used again at the slot machine 10 other than the one issuing the ticket is omitted due to simplification. In such case, a ticket with a new ticket ID assigned to the remaining amount at that time is issued in the procedure similar to that shown in FIG. 9.

Although detail description is omitted herein, the reused ticket is stored within the slot machine 10 and is recovered by the employee. When the remaining amount of the ticket is higher than a plying-fee, the server 100 may also update the ticket management database 105 to set the classification of the ticket state assigned to the ticket at "slot machine" and the location of the ticket state assigned to the ticket at "a machine number of the slot machine 10".

Figure 11:
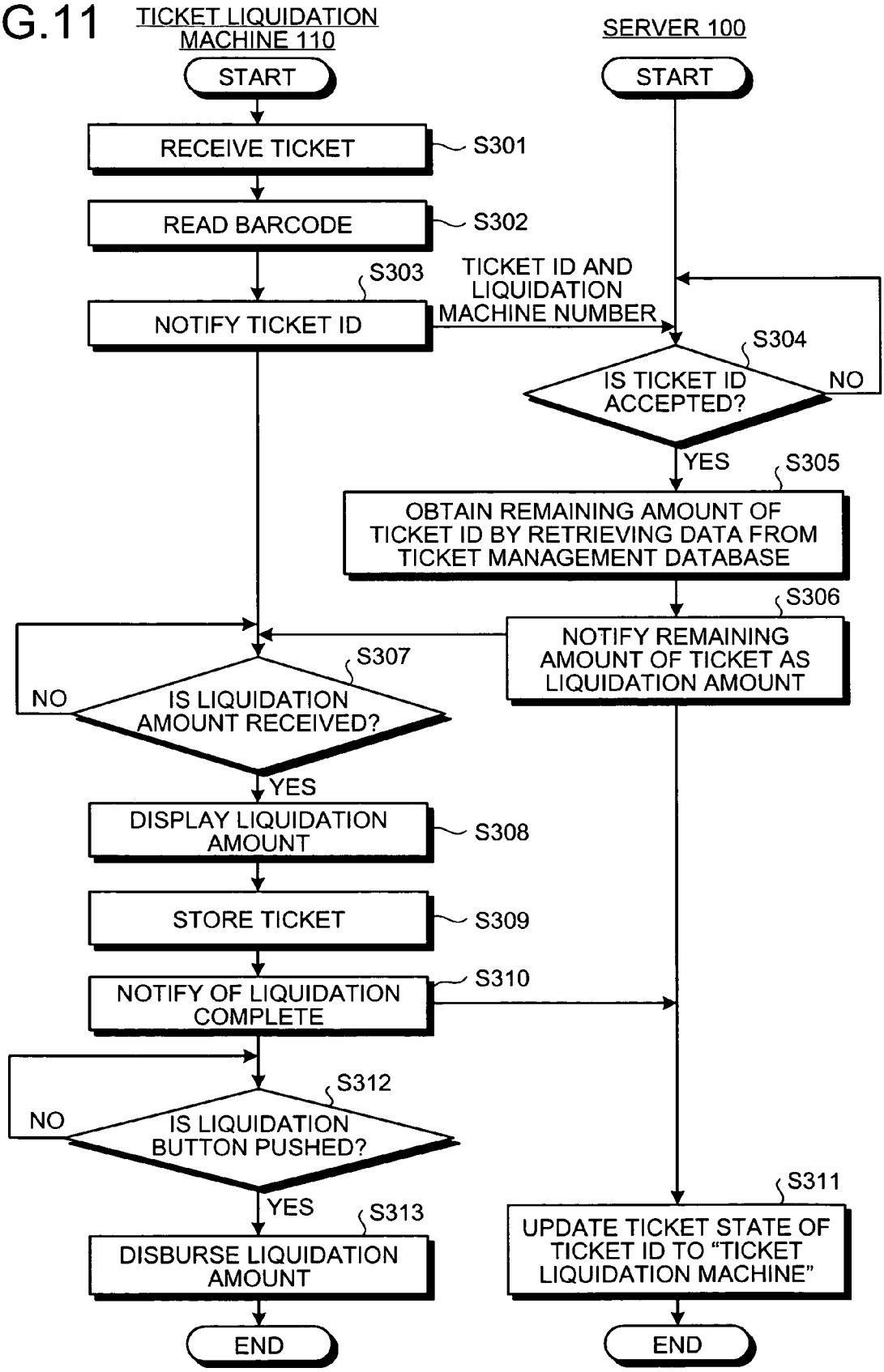
FIG. 11 is a flowchart of a ticket liquidation procedure performed by the ticket liquidation machine and the server shown in FIG. 8.

A ticket liquidation procedure performed by the ticket liquidation machine 110 is described below. FIG. 11 is a flowchart of the ticket liquidation procedure performed by the ticket liquidation machine 110. After the ticket liquidation machine 110 receives the ticket (Step S301), the ticket liquidation machine 110 reads a barcode printed on the ticket (Step S302), and sends a notice of a ticket ID obtained from the barcode along with a machine number of the ticket liquidation machine 110 to the server 100 (Step S303).

After the server 100 receives the ticket ID (YES at Step S304), the server 100 retrieves a remaining amount of the ticket assigned to the ticket ID from the ticket management database 105 (Step S305), and sends a notice of the remaining amount of the ticket to the ticket liquidation machine 110 as a liquidation amount (Step S306).

When the ticket liquidation machine 110 receives the liquidation amount (Yes at Step S307), the ticket liquidation machine 110 displays the liquidation amount on the liquid crystal display with touch panel section 113 (Step S308), and stores the ticket in the ticket cassette 110*i* (Step S309). After Step S309 is finished, the ticket liquidation machine 110 sends a liquidation complete notice to the server 100 (Step S310). When the liquidation complete notice is received, the server 100 updates the classification of the ticket state assigned to the ticket ID to "ticket liquidation machine" (Step S311). The location of the ticket state is set at "machine number of the ticket liquidation machine".

When the liquidation button displayed on the liquid crystal display with touch panel section 113 is pushed (YES at Step S312), the ticket liquidation machine 110 dispenses the liquidation amount from the bill output port 119 or the coin input/output port 117 (Step S313).

Figure 12:
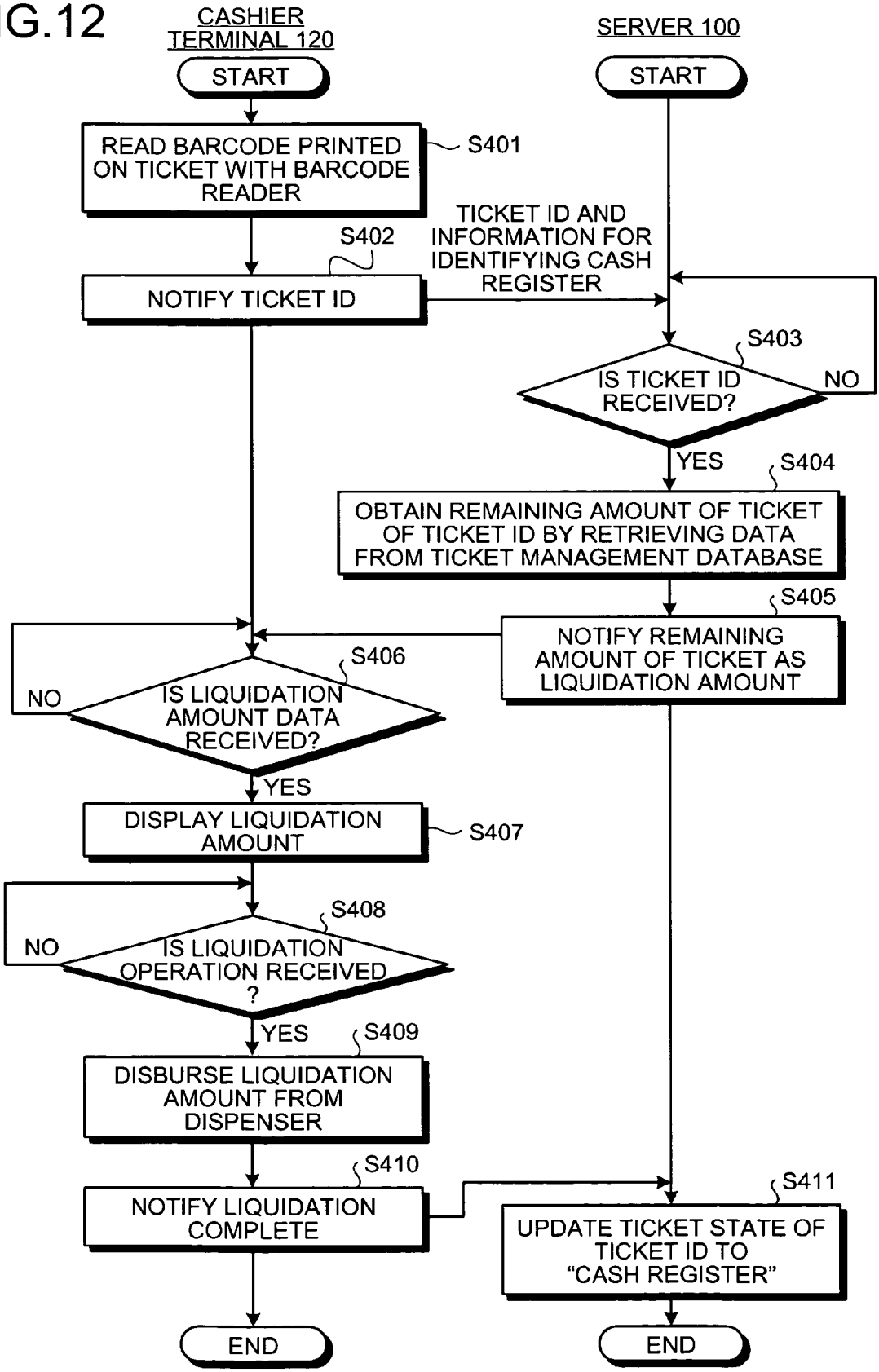
FIG. 12 is a flowchart of a ticket liquidation procedure performed by a cashier terminal and the server shown in FIG. 2.

A ticket liquidation procedure performed by the cashier terminal 120 is described below. FIG. 12 is a flowchart of the ticket liquidation procedure by the cashier terminal 120. As shown in FIG. 12, the cashier terminal 120 reads the barcode printed on the ticket with the barcode reader 121 connected thereto (Step S401), and sends a notice of a ticket ID obtained from the barcode along with information for identifying the cashier counter to the server 100 (Step S402). The information for identifying the cashier counter means information with which each of cashier counters is identified uniquely under the condition where two or more cashier counters are provided.

After the server 100 receives the ticket ID and the information for identifying the cashier counter (YES at Step S403), the server 100 obtains a remaining amount of the ticket assigned to the ticket ID by retrieving data from the ticket management database 105 (Step S404), and sends a notice of the remaining amount of the ticket to the cashier terminal 120 as a liquidation amount (Step S405).

When the cashier terminal 120 receives the liquidation amount (Yes at Step S406), the cashier terminal 120 displays the liquidation amount on a prespecified displaying section (Step S407). After the liquidation operation is received (YES at Step S408), the cashier terminal 120 dispenses the liquidation amount with the dispenser 122 (Step S409). The liquidated ticket is kept by a cashier.

After ending a series of the processes above described, the cashier terminal 120 sends a liquidation complete notice to the server 100 (Step S410). The server 100, after receiving the liquidation complete notice, updates the classification of the ticket state assigned to the ticket ID to "cashier counter" (Step S411). The location of the ticket state is set at "information for identifying the cashier counter".

Figure 13:
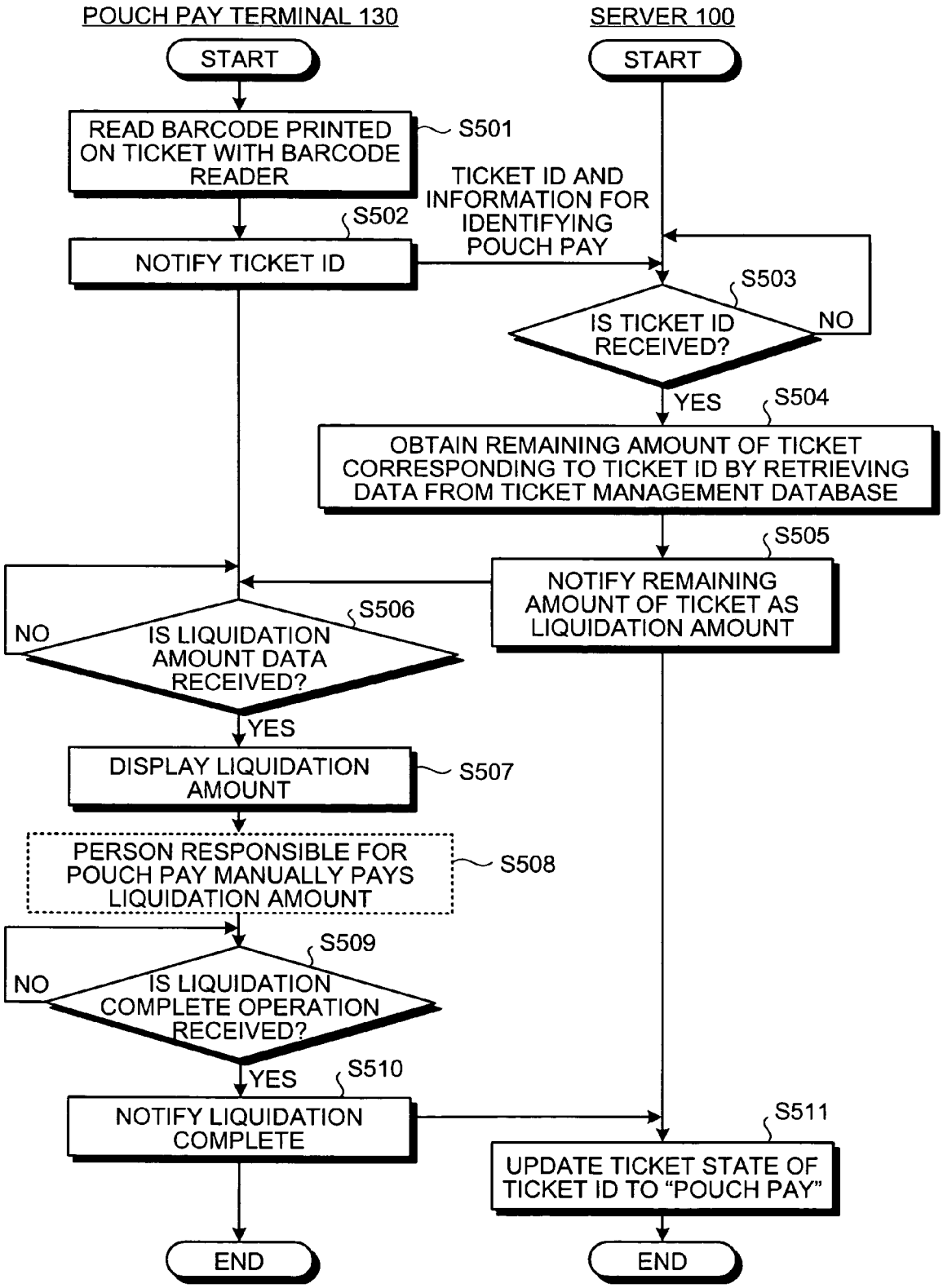
FIG. 13 is a flowchart of a ticket liquidation procedure performed by a pouch pay terminal and the server shown in FIG. 2.

A ticket liquidation procedure performed by pouch pay is described below. FIG. 13 is a flowchart of a ticket liquidation procedure by the pouch pay terminal 130. The pouch pay terminal 130 reads a barcode printed on the ticket with the barcode reader (Step S501), and sends a notice of a ticket ID obtained from the barcode along with information for identifying pouch pay to the server 100 (Step S502). The information for identifying pouch pay herein means information with which each of persons responsible pouch pay is identified uniquely under a condition where there are two or more persons responsible for pouch pay.

After the server 100 receives the ticket ID and the information for identifying pouch pay (YES at Step S503), the server 100 obtains a remaining amount of the ticket assigned to the ticket ID by retrieving data from the ticket management database 105 (Step S504), and sends a notice of the remaining amount of the ticket to the pouch pay terminal 130 as a liquidation amount (Step S505).

When the pouch pay terminal 130 receives the liquidation amount (YES at Step S506), the pouch pay terminal 130 displays the liquidation amount on a prespecified displaying section (Step S507). The pouch payer performs liquidation manually by checking the liquidation amount with eyes (Step S508). The liquidated ticket is kept by the person responsible pouch pay.

After receiving the liquidation complete operation (YES at Step S509), the pouch pay terminal 130 sends a notice of liquidation completion to the server 100 (Step S510). The server 100, after receiving the notice of liquidation completion, updates the classification of the ticket state assigned to the ticket ID to "pouch payer" (Step S511). The location of the ticket state is set at "information for identifying pouch pay".

Figure 14:
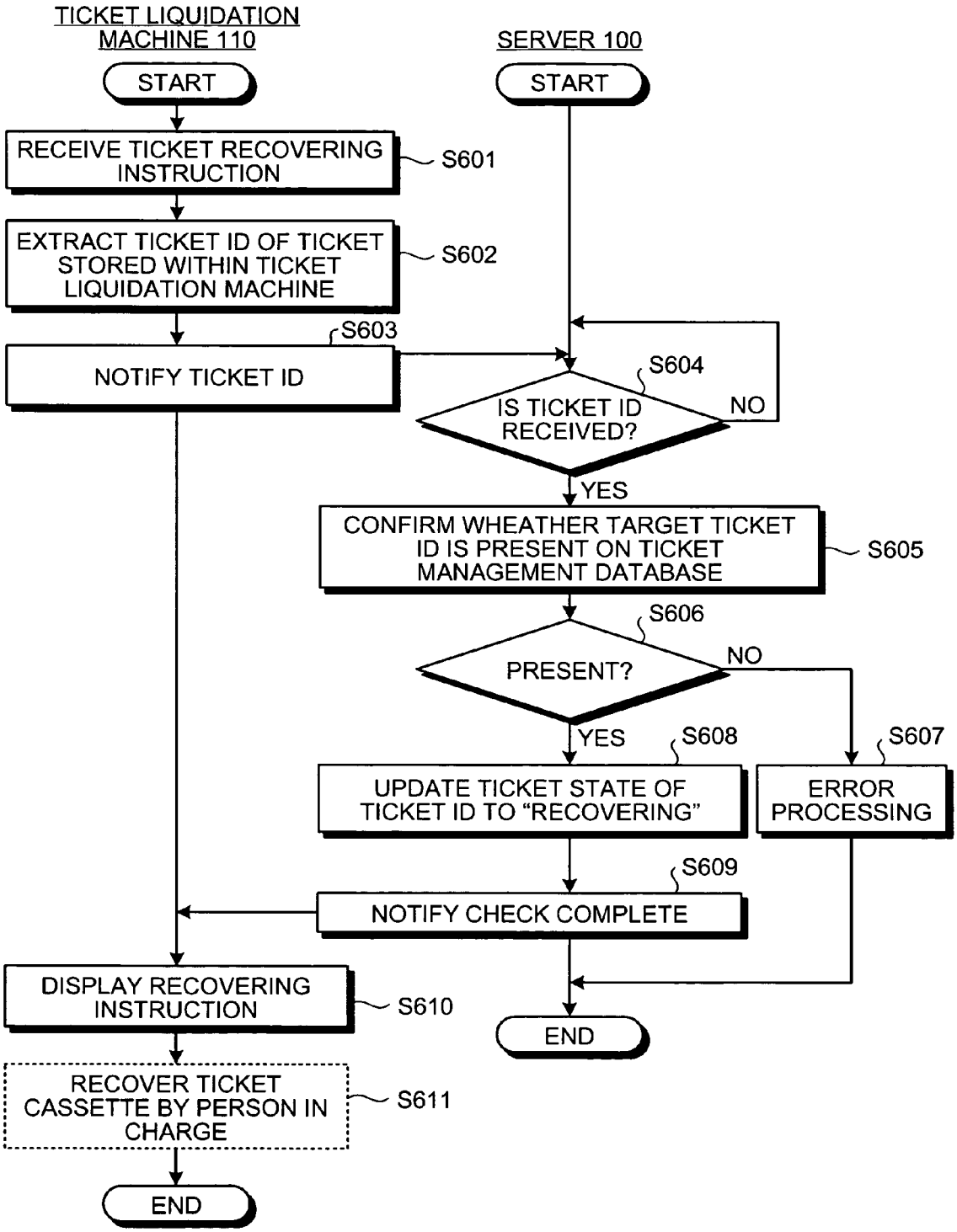
FIG. 14 is a flowchart of a ticket recovering procedure performed by the ticket liquidation machine and the server shown in FIG. 2.

A ticket recovering procedure performed by the ticket liquidation machine 110 is described below. FIG. 14 is a flowchart of the ticket recovering procedure performed by the ticket liquidation machine 110. As shown in FIG. 14, after the ticket liquidation machine 110 receives a ticket recovering instruction (step S601), the ticket liquidation machine 110 extracts a ticket ID of the ticket stored therein (Step S602) and sequentially sends a notice of extracted ticket ID to the server 100 (Step S603). Practically, the ticket liquidation machine 110 records the ticket ID of the liquidated ticket on the recording section 110*e* whenever the ticket liquidation is performed, and reads out the ticket ID recorded on the recording section 110*e* in response to the ticket recovering instruction.

When the server 100 receives all of the ticket IDs (YES at Step S604), the server 100 confirms whether each ticket ID is present on the ticket management database 105 (Step S605). When the targeted ticket ID is not present (NO at Step S606), error processing is performed against the ticket ID (Step S607).

When the ticket ID is present (YES at Step S606), the server 100 updates the classification of the ticket state assigned to the ticket ID to "recovering" (Step S608) and sends a notice of check complete to the ticket liquidation machine 110 (Step S609).

The ticket liquidation machine 110, after receiving the notice of check complete, displays a recovering instruction on the liquid crystal display with touch panel section 113 (Step S610) to remind an employee of recovering the ticket cassette 110*i*. The employee who sees the display recovers the ticket cassette 110*i* (Step S611).

In the present embodiment, as described above, "recovering" and "recovered" is separately used for classification of the ticket state. "Recovering" is used during a period starting at the employee recovers the ticket cassette 110*i* and ending before the counting machine 140 counts the recovered ticket cassette 110*i*. Such process is employed to prevent occurrence that the liquidated ticket is picked up during the period. It is not until the counting machine 140 counts the liquidate ticket that the liquidate ticket is updated to "recovered".

Figure 15:
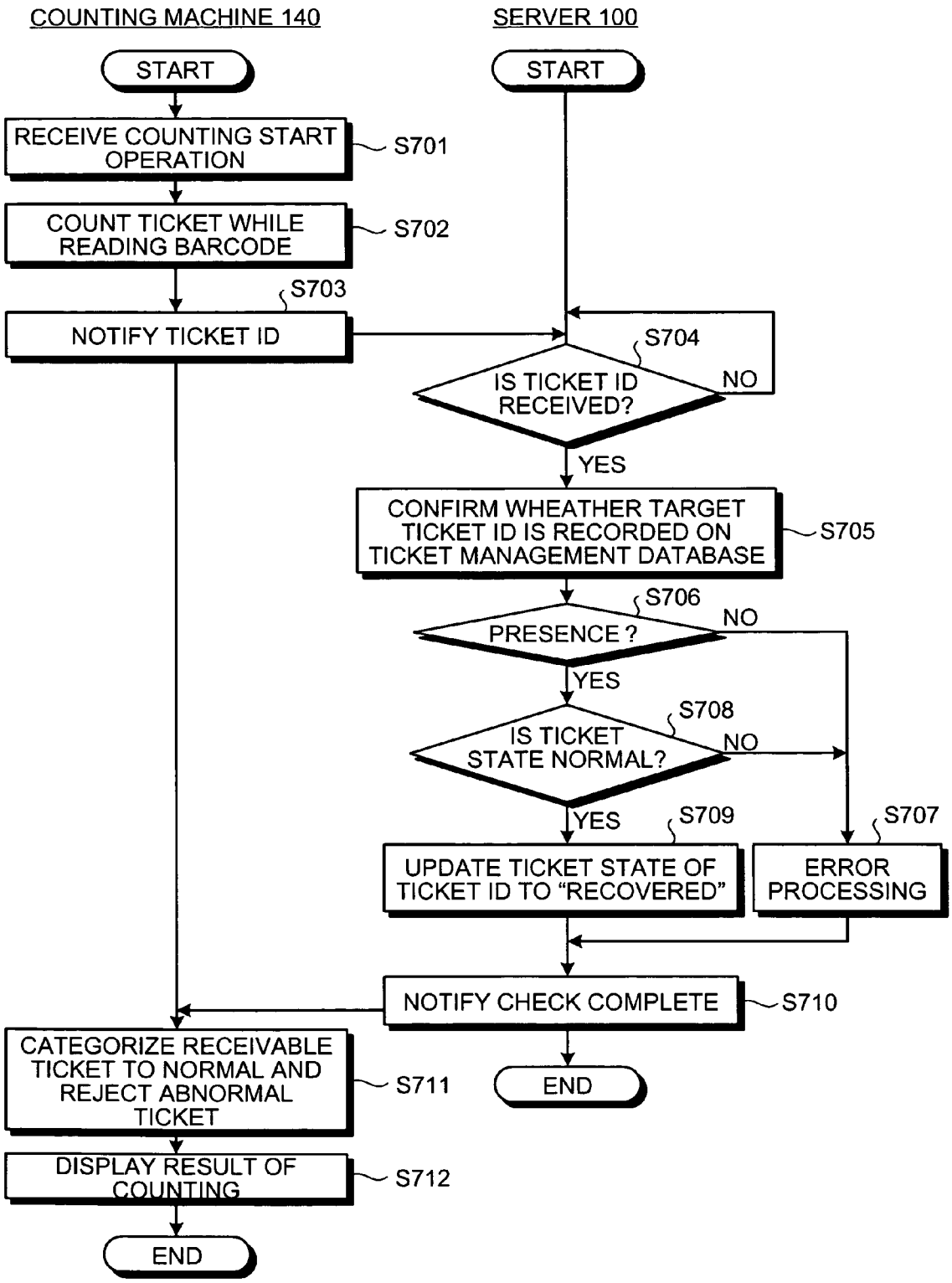
FIG. 15 is a flowchart of a ticket recovering procedure performed by a counting machine and the server shown in FIG. 2.

A ticket recovering procedure performed by the counting machine 140 is described below. FIG. 15 is a flowchart of the ticket recovering procedure by the counting machine 140. As shown in FIG. 15, after the liquidated ticket is set at the counting machine 140 and the counting machine 140 receives the counting start operation (Step S701), the counting machine 140 reads a barcode printed on each liquidated ticket while counting the number of tickets (Step S702) and sends a notice of each ticket ID to the server 100 (Step S703).

After the server 100 receives a notice of each ticket ID (YES at Step S704), the server 100 confirms whether each ticket ID is present on the ticket management database 105 (Step S705). When the target ticket ID is not present (NO at Step S706), the server 100 performs error processing against the ticket ID (Step S707).

When the target ticket ID is present (YES at Step S706) and the ticket state is normal (YES at Step S708), the server updates classification of the ticket state assigned to the ticket ID to "recovered" (Step S709) and sends a notice of check result to the counting machine 140 (Step S710). When the ticket state is abnormal (NO at Step S708), the server 100 performs error processing against the ticket ID assigned thereto (Step S707).

After the counting machine 140 receives the notice of the check result, the counting machine 140 classifies the ticket into normal or abnormal depending on the check result being OK or NG and rejects the ticket classified into abnormal (Step S711), and displays the counting result (Step S712).

As described above, a state of the ticket counted by the counting machine 140 is set at "recovered" and physically managed within the counting machine 140.

Figure 16:
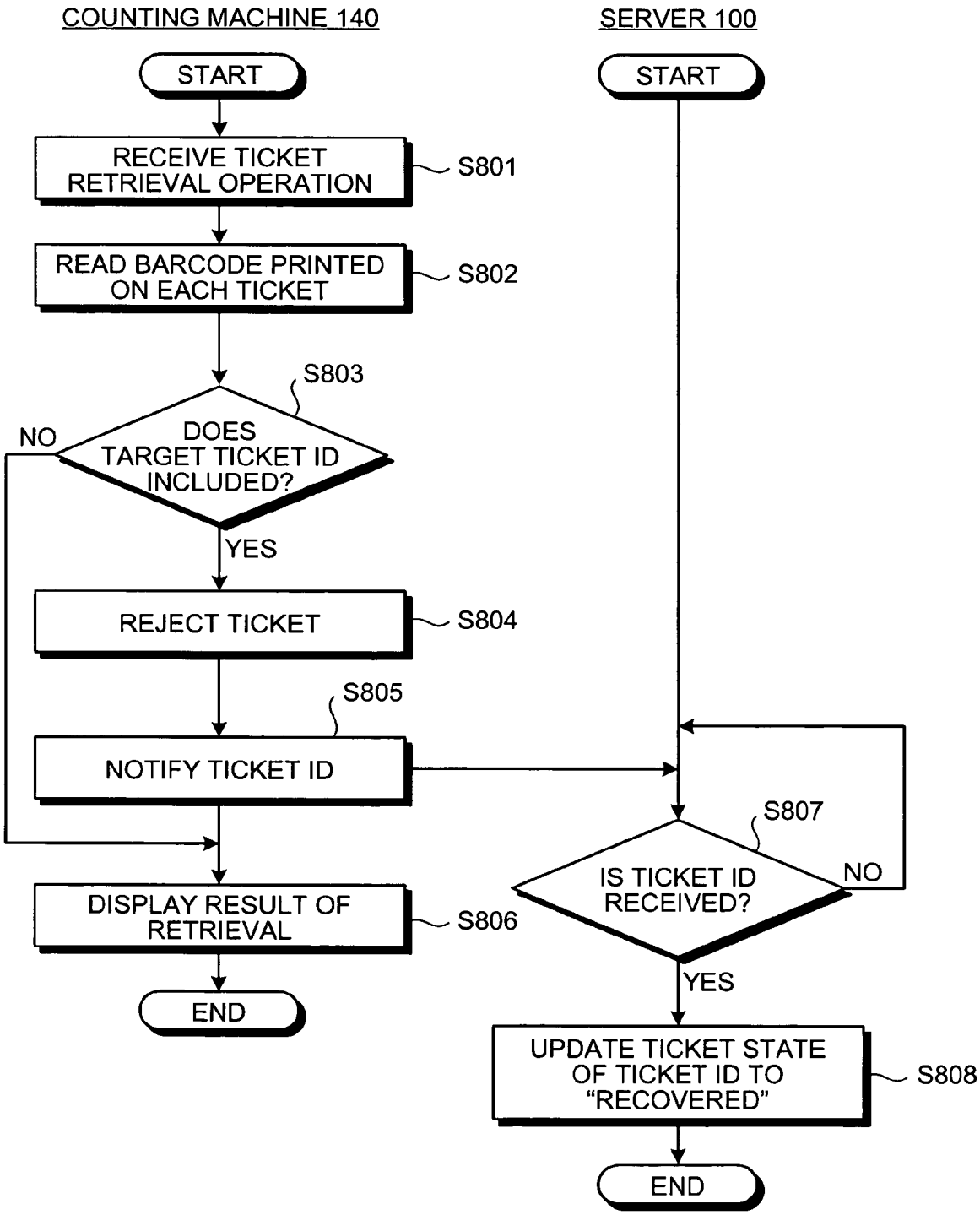
FIG. 16 is a flowchart of a ticket retrieval procedure performed by the counting machine and the server shown in FIG. 2.

The counting machine 140 can retrieve a ticket with a specified ticket ID as well as simply count the number of tickets. A ticket retrieval procedure performed by the counting machine 140 is described below. FIG. 16 is a flowchart of the ticket retrieval procedure performed by the counting machine 140. An example is illustrated where a ticket with a specific ticket ID is retrieved a plurality tickets which are not recovered currently.

As shown in FIG. 16, after the counting machine 140 providing a plurality of tickets as a target for counting receives a ticket retrieval operation with a specific ticket ID assigned to a target ticket (Step S801), the counting machine 140 reads each barcode printed on the plurality of tickets (Step S802) and obtains each ticket ID from the barcode (Step S803).

The counting machine 140 confirms whether the specific ticket ID is present among the obtained ticket IDs. When the specific ticket ID is present (YES at Step S803), the counting machine 140 rejects the ticket assigned to the specific ticket ID (Step S804), sends a notice of the specific ticket ID to the server 100 (Step S805), and displays the retrieval result on the predefined displaying section (Step S806). The server 100, after receiving the ticket ID (YES at Step S807), updates classification of the ticket state assigned to the ticket ID to "recovered" (Step S808).

Figure 17:
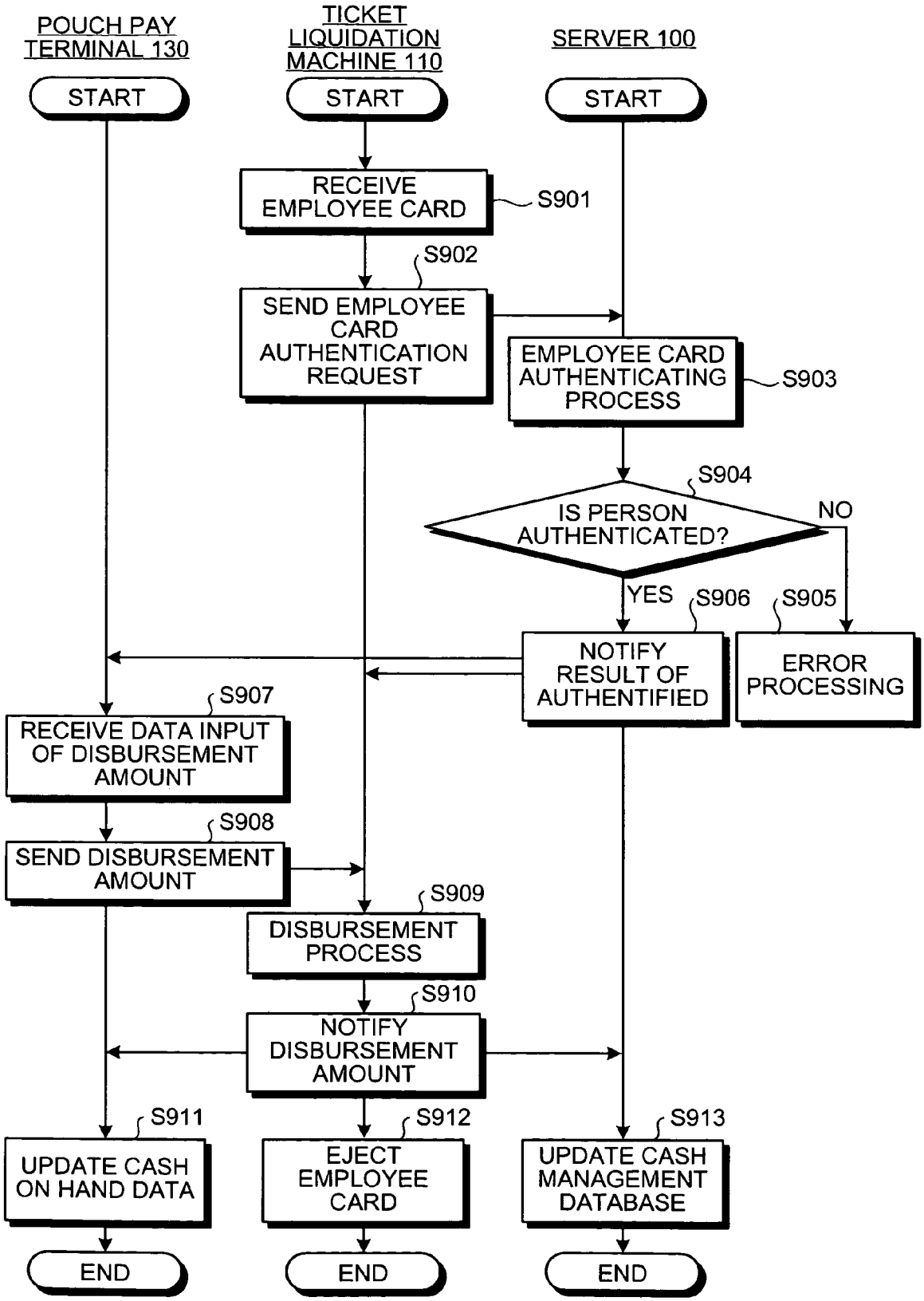
FIG. 17 is a flowchart of a disbursing procedure performed by the pouch pay terminal, the ticket liquidation machine, and the server shown in FIG. 2.

A processing procedure for identifying a location where reserve for pouch pay is disbursed from the ticket liquidation machine 110 is described below. FIG. 17 is a flowchart of the processing procedure where reserve for the pouch pay is disbursed from the ticket liquidation machine 110.

As shown in FIG. 17, after the ticket liquidation machine 110 receives an employee card from the card insertion port 116 (Step S901), the ticket liquidation machine 110 sends a notice of an employee code for requesting employee authentication to the server 100 (Step S902). Information for the employee-authentication request may include a security code. In such case the employee should input the security code.

The server 100, after receiving the employee-authentication request, performs an authenticating process for determining whether the person is a real employee or not (Step S903). When the person is not authenticated (NO at Step S904), the server 100 performs error processing (Step S905). As the error processing, the server 100 may notify occurrence of the error processing to a manager in addition to returning the employee card with displaying the result of authentication.

While, when the person is authenticated (YES at Step S904), the server 100 switches from the normal mode to the employee mode, and notifies the mode switch to the ticket liquidation machine 110 as well as to the pouch pay terminal 130 (Step S906). The pouch pay terminal 130, after receiving the notice that the person is authenticated, inputs a disbursement amount for reserve (Step S907) and sends the disbursement amount to the ticket liquidation machine 110 (Step S908).

The ticket liquidation machine 110, after receiving the notice of the disbursement amount, performs disbursement (Step S909), sends a notice of the disbursement amount to the pouch pay terminal 130 and the server 100 (Step S910) and ejects the employee card from the card insertion port 116 (Step S912).

The pouch pay terminal 130 updates the current cash amount on hand (Step S911) and the server 100, after receiving the notice of disbursement amount, updates the cash management database 106 (Step S913).

By performing the series of processes described above, the reserve for the pouch pay is disbursed from the ticket liquidation machine 110 while the current cash amount on pouch pay is correctly managed by the pouch pay terminal 130 and the cash management database 106 of the server 100.

Figure 18:
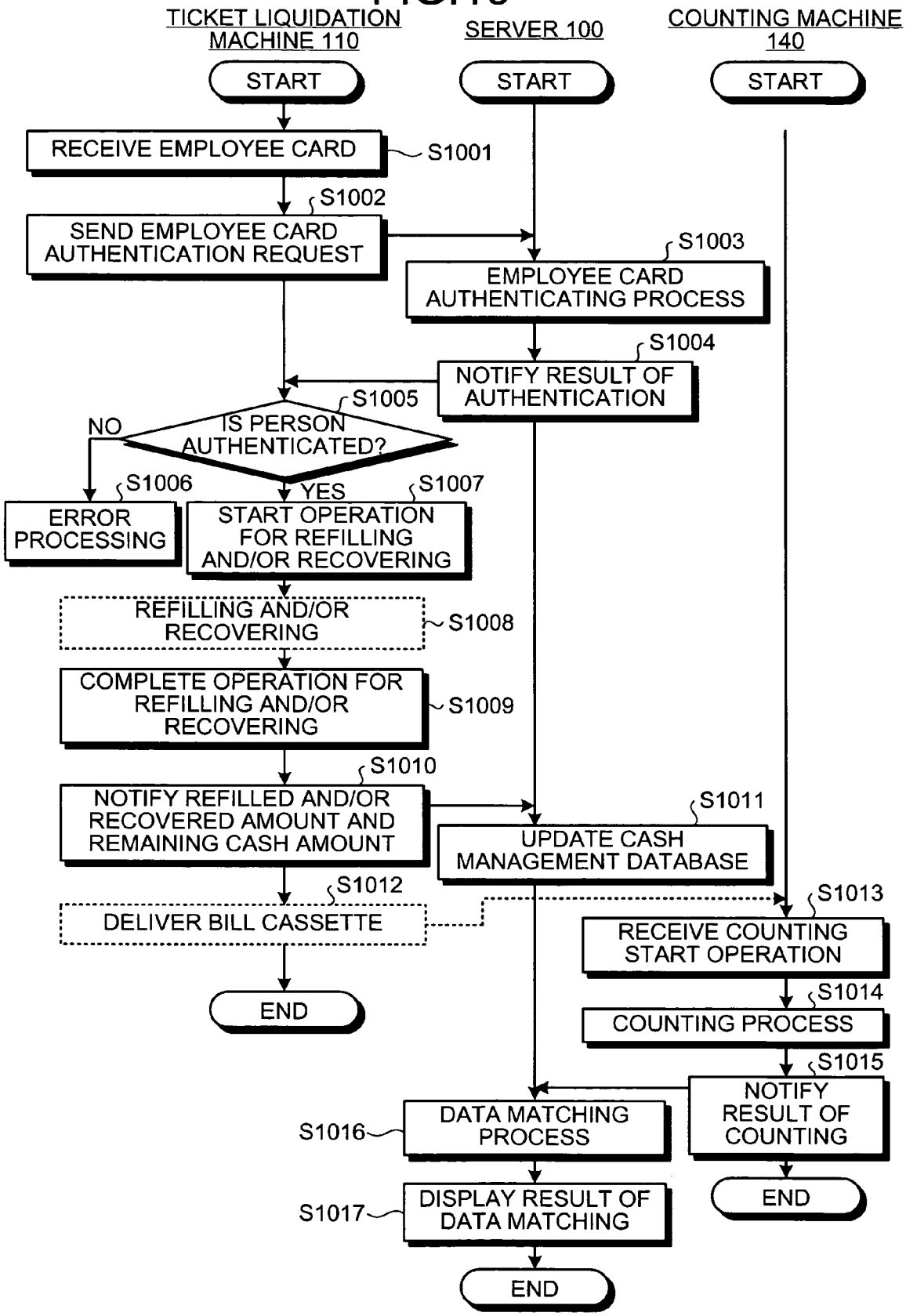
FIG. 18 is a flowchart of a cash refilling and/or recovering procedure performed by the ticket liquidation machine, the server, and the counting machine shown in FIG. 2.

A cash refilling and/or recovering procedure performed by the ticket liquidation machine 110 is described below. FIG. 18 is a flowchart of the cash refilling and/or recovering performed by the ticket liquidation machine 110.

As shown in FIG. 18, the ticket liquidation machine 110, after receiving an employee card from the card insertion port 116 (Step S1001), sends the employee code to the server 100 for an employee-authentication request (Step S1002). Information for the employee-authentication request may include a security code. In such case the employee should input the security code.

The server 100, after receiving the employee-authentication request, performs an authenticating process for determining whether the person is a real employee or not (Step S1003), and sends a notice of a result of the authentication to the ticket liquidation machine 110 (Step S1004).

When the person is not authenticated (NO at Step S1005), the server 100 performs error processing (Step S1006). As the error processing, the server 100 may notify occurrence of the error processing in addition to returning the employee card to a manager with displaying the result of authentication.

While when the person is authenticated (YES at Step S1005), the server 100 starts an operation for cash refilling and/or recovering cash (Step S1007). For instance, when the person is authenticated, the server 100 may control the ticket liquidation machine to display a refilling/recovering button on the liquid crystal display with touch panel section 113 and shifts the operating mode enabling refilling and/or recovering when the start button for refilling/recovering is pushed.

When the employee finishes the cash refilling and/or recovering operation (Step S1008), the ticket liquidation machine 110 receives an operation for completing the cash refilling and/or recovering operation (Step S1009). Similar to the start button for refilling/recovering, for the operation for completing the cash refilling and/or recovering operation, the completion button may be displayed on the liquid crystal display with touch panel section 113. In this case, the operation for cash refilling and/or recovering is assumed to be completed when the completion button for refilling/recovering is pushed.

After the processes described above, the ticket liquidation machine 110 sends a notice of refilled or -recovered amount and the remaining amount to the server 100 (Step S1010), and the server 100, after receiving the information, updates the cash management database 106 (Step S1011).

The employee delivers the bill cassette to the counting machine 140 (Step S1012). The counting machine 140, after receiving a counting start operation with cash is set thereon (Step S1013), performs a cash counting process (Step S1014), and sends a notice of a result of counting to the server 100 (Step S1015).

The server 100, after receiving the notice, performs a matching process in which matching the refilled or -recovered amount received from the ticket liquidation machine 110 with the counting result performed by the counting machine 140 (Step S1016), and displays the result of matching (Step S1017).

The series of processes described above will ensure to prevent dishonesty of the employee such as picking up cash during the cash refilling and/or recovering operation at the ticket liquidation machine 110.

Figure 19:
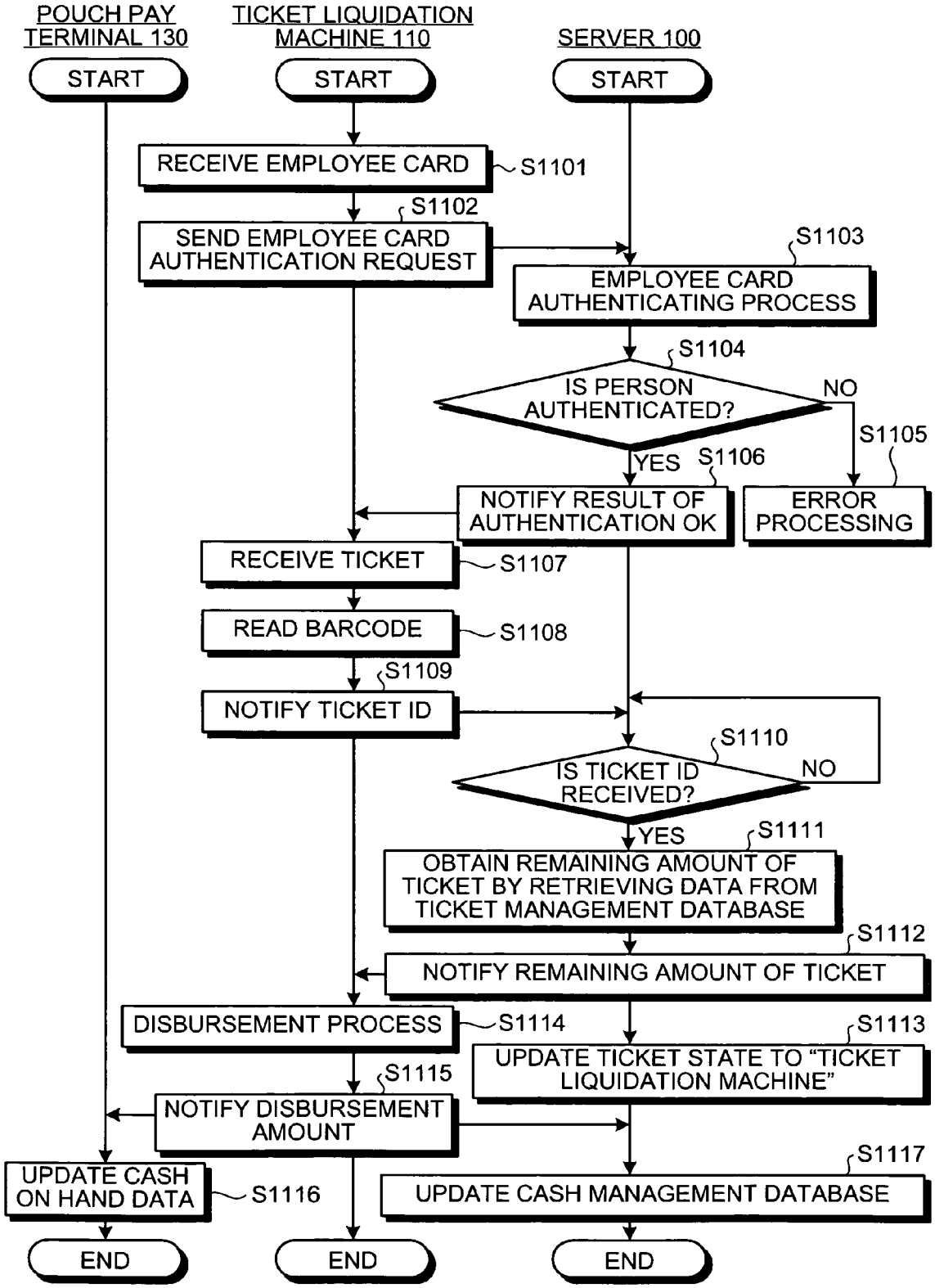
FIG. 19 is a flowchart of a cashing procedure performed by the pouch pay terminal, the ticket liquidation machine, and the server shown in FIG. 2.

A cashing process by the ticket liquidation machine 110 of a ticket kept by a pouch payer is described below. FIG. 19 is a flowchart of the cashing procedure by the ticket liquidation machine 110 of a liquidated ticket kept by a pouch payer. The ticket liquidation machine 110, after receiving an employee card of the pouch payer from the card insertion port 116 (Step S1101), sends an employee code of the pouch payer for an employee-authentication request to the server 100 (Step S1102). Information for the employee-authentication request may include a security code. In such case the employee should input the security code.

The server 100, after receiving the employee-authentication request, performs an authenticating process for determining whether the pouch payer is authenticated or not (Step S1103). When the person is not authenticated (NO at Step S1104), error processing is performed (Step S1105). As the error processing, the server 100 may notify occurrence of the error processing to a manager in addition to returning the employee card hold by the pouch payer with displaying the result of authentication.

While, when the person is authenticated (YES at Step S1106), the ticket liquidation machine 110 switches from the normal mode to the employee mode and receives the ticket having been subjected to the primary liquidation by the pouch payer (Step S1107), reads a barcode printed on the ticket (Step S1108), and sends a ticket ID obtained from the barcode to the server 100 (Step S1109).

The server 100, after receiving the ticket ID (YES at Step S1110), retrieves a remaining amount of the ticket assigned to the ticket ID from the ticket management database 105 (Step S1111). Then, the server sends a notice of the remaining amount of the ticket to the ticket liquidation machine 110 (Step S1112), and updates the ticket state to "ticket liquidation machine" (Step S1113).

The ticket liquidation machine 110 performs the disbursement process of the remaining amount of the ticket sent from the server 100 (Step S1114), and sends a notice of the disbursement amount to the pouch pay terminal 130 and the server 100 (Step S1115).

The pouch pay terminal 130, after receiving the disbursement amount, adds the current cash amount recorded therein and the disbursement amount to update data (step S1116). The server 100, after receiving the disbursement amount, updates the cash management database 106 (Step S1117).

In the present embodiment, as described above, a ticket kept by a pouch payer and having been subjected to the primary liquidation can be subjected to the secondary liquidation by the ticket liquidation machine 110, and a cash amount kept by the pouch payer can strictly be managed by the pouch pay terminal 130 and the cash management database 106 of the server 100.

Moreover, the ticket state with the ticket is strictly managed in the ticket management database 105 provided in the server 100, and also the liquidated tickets are centrally managed in the counting machine 140, so that illegal use of the liquidated tickets can be prevented. Furthermore, cash is accurately managed by managing the cash within the ticket liquidation machine 110 together with the remaining cash amount kept by the pouch payer using the cash management database 106 provided in the server 100.

Unlike the conventional system, the ticket liquidation machine 110 can dispense a reserve for the pouch payer and perform the secondary liquidation of a ticket having been subjected to the primary liquidation kept by the pouch payer. The ticket liquidation machine 110 according to the present embodiment enables prompt and effective operations performed by the pouch payer.

In the first embodiment, description for processes concerning a jackpot meaning the situation where a player wins a big hit during a game is omitted. Therefore, processes performed when a jackpot is generated are described in a second embodiment.

Figure 20:
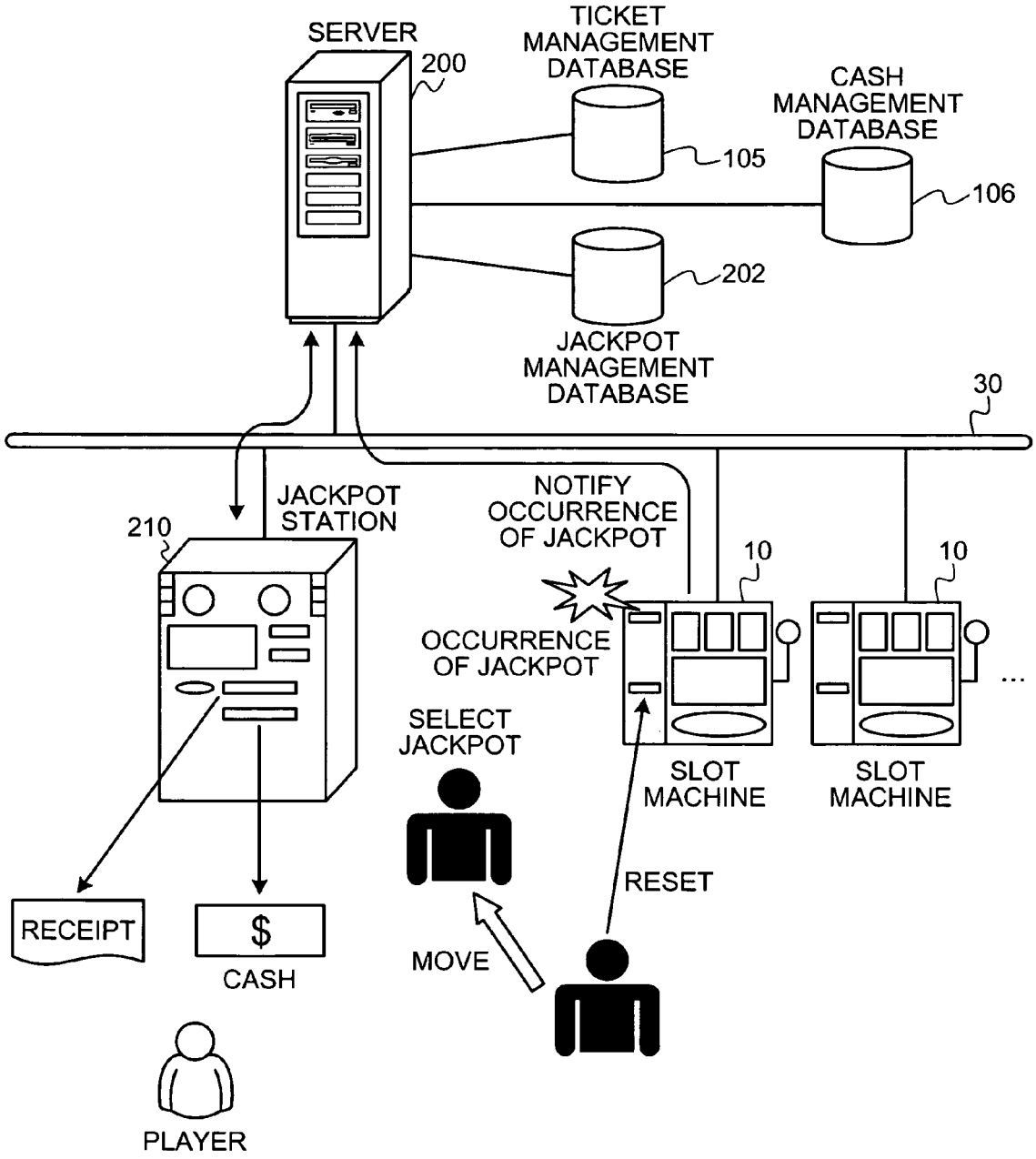
FIG. 20 is a schematic for explaining the concept for a process performed when a jackpot occurs according to a second embodiment of the present invention.

FIG. 20 is a schematic for explaining the concept for a process performed when a jackpot occurs according to the second embodiment of the present invention. The ticket management system includes a server 200. A jackpot management database 202 and a jackpot station 210 are connected to the server 200 via the LAN 30.

When the jackpot occurs at the slot machine 10, the slot machine 10 gets frozen and is switched to an employee mode. An employee walks to the slot machine 10 at which the jackpot occurs, and resets the slot machine 10. Next, the employee comes to the jackpot station 210 with a qualified supervisor and the player.

When the employee selects a jackpot on the jackpot station 210, the jackpot station dispenses cash corresponding to the jackpot amount, and prints and outputs a receipt and a tax practice application card. Information concerning the jackpot is centrally managed in the jackpot management database 202. Therefore, unlike the conventional system, dispense of cash for the jackpot and output of the receipt and the tax practice application card are performed without a help of any employee. Because a large amount of cash is handled at the jackpot station 210, the jackpot station 210 is preferably provided at a position close to a place where an employee, such as a cashier, always stays.

Figure 21:
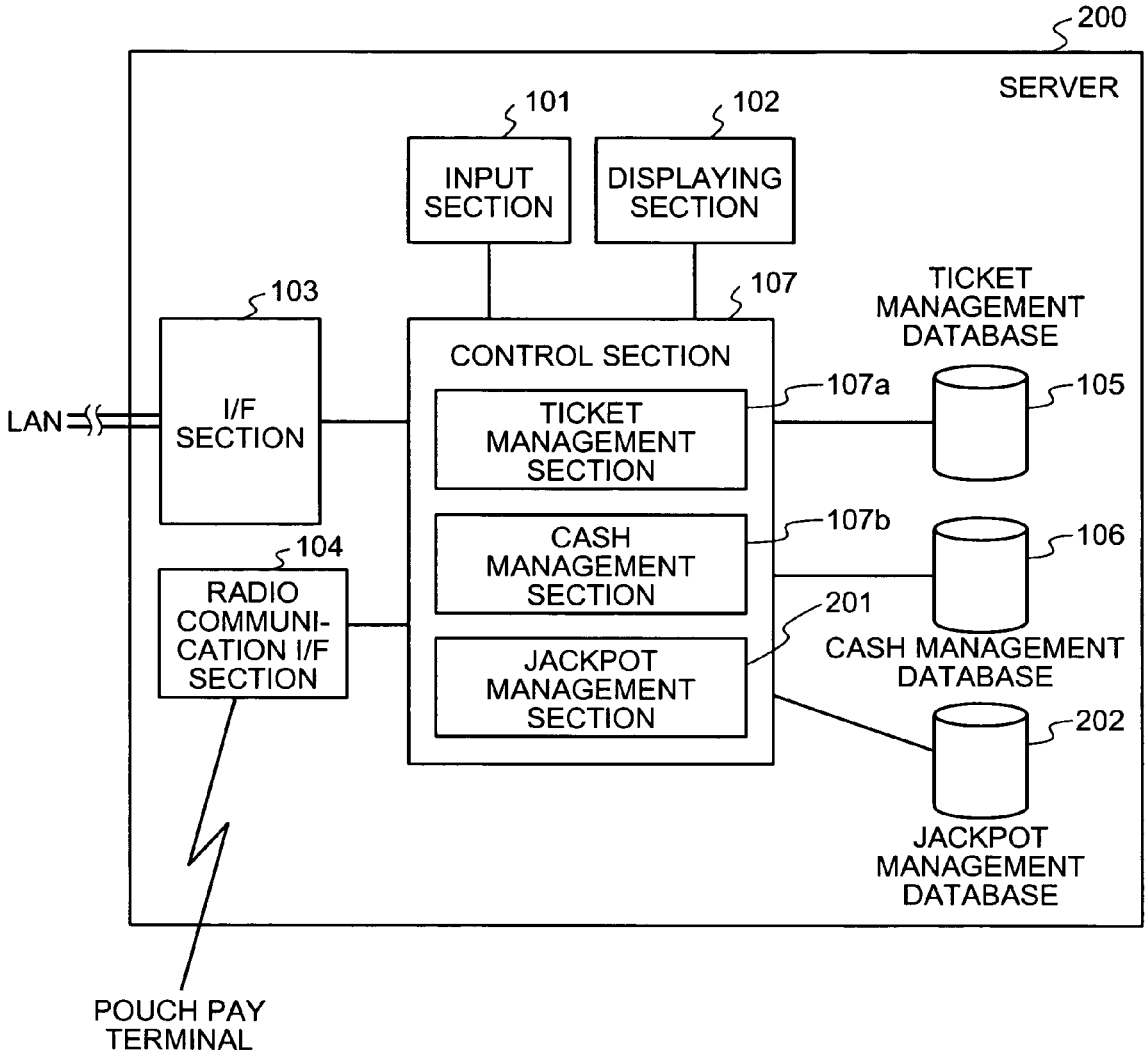
FIG. 21 is a detailed functional block diagram of a server shown in FIG. 20.

FIG. 21 is a functional block diagram of the server 200. The server 200 includes a jackpot management section 201 in the control section 107 shown in FIG. 4, and the jackpot management database 202. Functional sections other than the jackpot management section 201 and the jackpot management database 202 are similar to those shown in FIG. 4. Therefore, the same reference number is assigned to each section instead of making a detail description.

The jackpot management section 201 manages occurrence and a state of the jackpot using the jackpot management database 202. The jackpot management section 201, after receiving a notice of occurrence of a jackpot from the slot machine 10, assigns a jackpot ID to the jackpot, and registers information on the jackpot management database 202 such as a date and time of occurrence, a cash amount, and a machine number of the slot machine 10 for the jackpot. At occurrence of the jackpot, a jackpot state is set at "occurrence", and updated to "liquidated" after a liquidation process is completed at the jackpot station 210. In addition, information such as an address and a name of the player who gets the jackpot is registered on the jackpot management database 202. Because such information is required to issue the tax practice application card, the employee inputs the information during the liquidation process.

Figure 22:
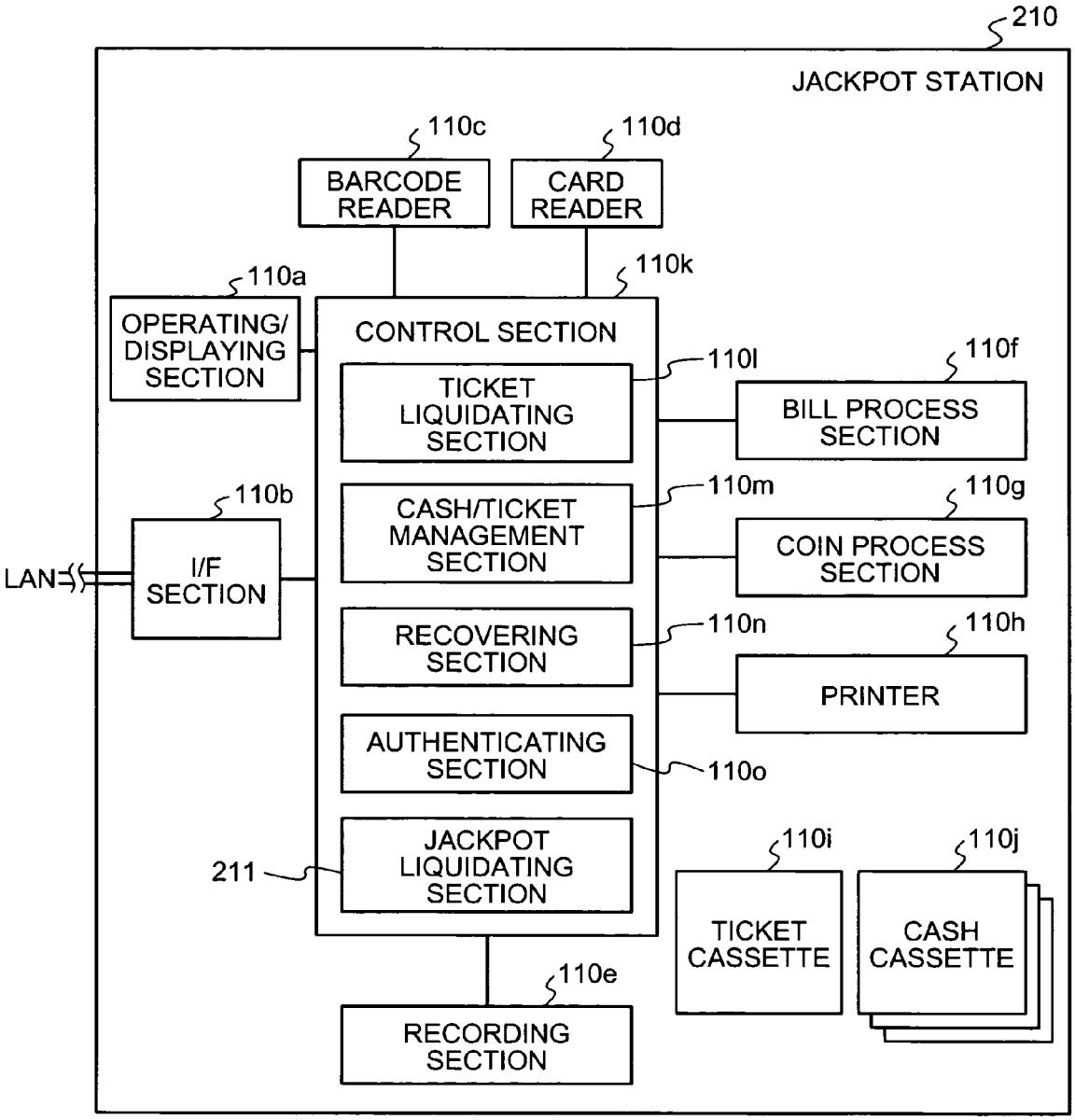
FIG. 22 is a detailed functional block diagram of a jackpot station shown in FIG. 20.

FIG. 22 is a detailed functional block diagram of the jackpot station 210. The jackpot station 210 is configured based on the ticket liquidation machine 110 shown in FIG. 8 and includes, different from the first embodiment, a jackpot liquidating section 211.

The jackpot liquidating section 211, when an employee selects a jackpot, performs the liquidation process of the selected jackpot and controls to print a receipt and a tax practice application card.

Figure 23:
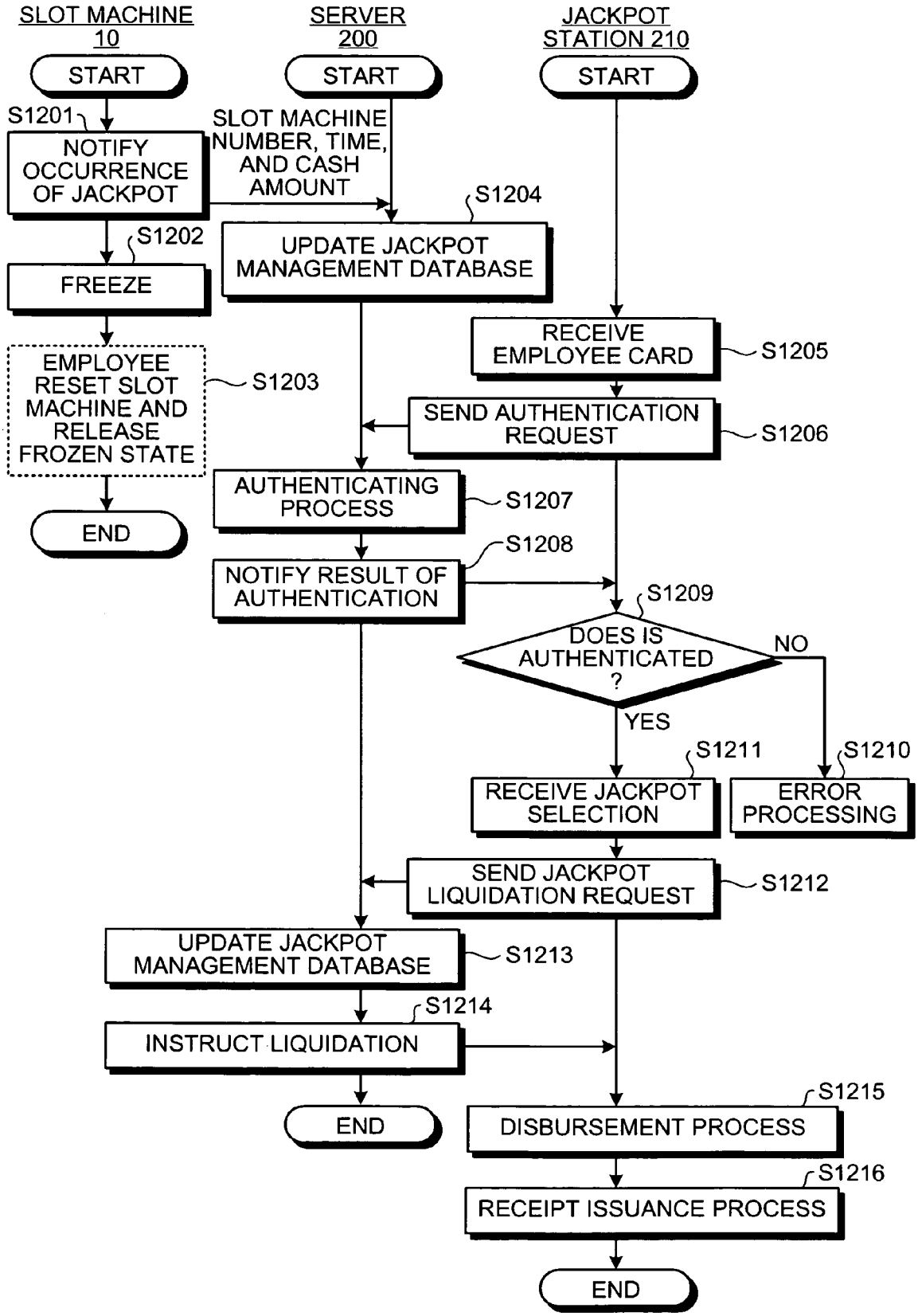
FIG. 23 is a flowchart of a jackpot liquidating procedure performed by the slot machine, the server, and the jackpot station shown in FIG. 20.

A liquidation process of a jackpot occurred at the slot machine 10. FIG. 23 is a flowchart of a jackpot liquidating procedure when a jackpot occurs at the slot machine 10.

As shown in FIG. 23, when a jackpot occurs at the slot machine 10, the slot machine 10 sends a notice of occurrence of the jackpot to the server 200 (Step S1201). The notice of occurrence of the jackpot includes a machine number of the slot machine 10, a date and time of occurrence of the jackpot, and a cash amount for the jackpot. After sending the notice, the slot machine 10 gets frozen (Step S1202) and an employee comes to reset the frozen state through a reset process (Step S1203). The employee, after completing the reset process, comes to the jackpot station 210 together with the player and a supervisor.

The server 200, after receiving the notice of occurrence of the jackpot, generates the jackpot ID and registers information on the jackpot management database 202 such as the machine number of the slot machine 10, the date and time of occurrence, and the cash amount for the jackpot (Step S1204).

The jackpot station 210, after receiving an employee card (Step S1205), sends a request for authentication with the employee card to the server 200 (Step S1206). Information for the employee-authentication request may include a security code. In such case, the employee should input the security code.

The server 200, after receiving the request for authentication, performs a process for authenticating the employee (Step S1207), and returns a result of authentication to the jackpot station 210 (Step S1208). The jackpot station 210, when the employee is not authenticated (NO at Step S1209), performs error processing (Step S1210). While, when the employee is authenticated (YES at Step S1209), the jackpot station 210 displays the jackpot ID of each jackpot being subject to the liquidation on the liquid crystal display with touch panel section 113 to receive an jackpot selection input by the employee (Step S1211), sends a liquidation request of the selected jackpot to the server 200 (Step S1212).

The server 200, after receiving the liquidation request, updates a state assigned to the jackpot ID on the jackpot management database 202 to "liquidated" (Step S1213), and sends a liquidation instruction to the jackpot station 210 (Step S1214).

The jackpot station 210, after receiving the liquidation instruction, disburses the liquidated amount (Step S1215), and also issues a receipt and a tax practice application card (Step S1216). Information for the tax practice application card should be input with the liquid crystal display with touch panel section 113.

In the second embodiment, as described above, the jackpot station 210 includes an additional function based on the ticket liquidation machine 110 of the first embodiment to perform the liquidation process and the issuance process of the receipt and the tax practice application card when the jackpot occurs at the slot machine 10. As a result, a jackpot can efficiently be handled without a help of any employee.

In the second embodiment described above, an employee selects a jackpot at the jackpot station 210 when the jackpot occurs. With the configuration as described above, however, the employee may select a wrong jackpot.

Figure 24:
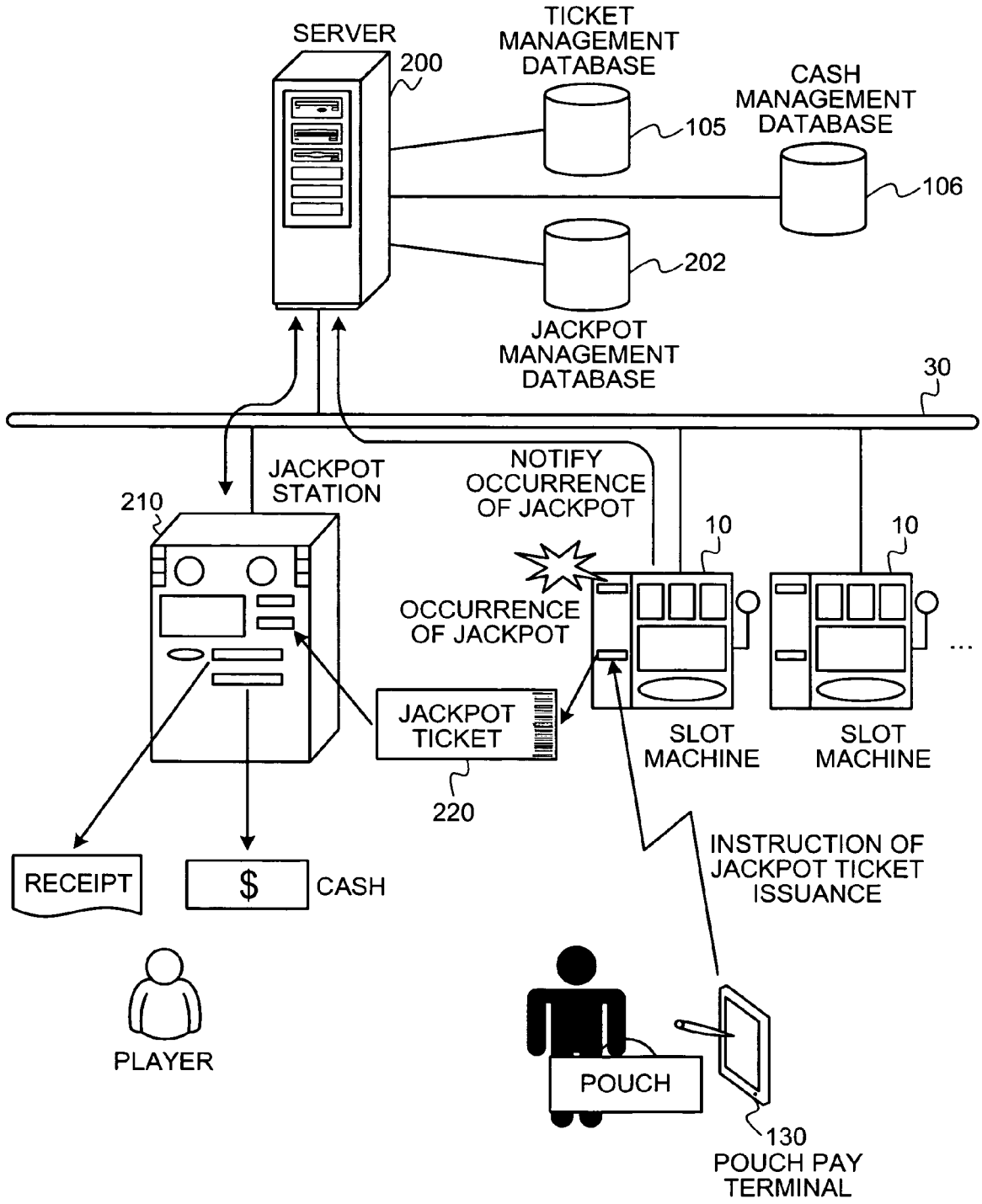
FIG. 24 is a schematic for explaining the procedure of selecting a jackpot with a jackpot ticket.

Another example is described below for introducing a system of preventing an operational mistake of selecting a wrong jackpot performed by an employee. FIG. 24 is a schematic for explaining the procedure of selecting a jackpot with a jackpot ticket. When a jackpot occurs at the slot machine 10, an employee sends an issuance instruction of a jackpot ticket using the pouch pay terminal 130 to the slot machine 10. The slot machine 10, in response to the issuance instruction, issues a jackpot ticket.

In the case, a liquidation request is sent from the employee by inserting the jackpot ticket into the jackpot station 210, so that the jackpot being subject to liquidation is uniquely identified.

The jackpot ticket herein indicates a ticket with a barcode printed thereon and includes a jackpot ticket ID issued by the server 200 according a procedure similar to that for the normal ticket. The jackpot ticket is used for uniquely identifying the jackpot being subject to the liquidation at the jackpot station 210.

Figure 25:
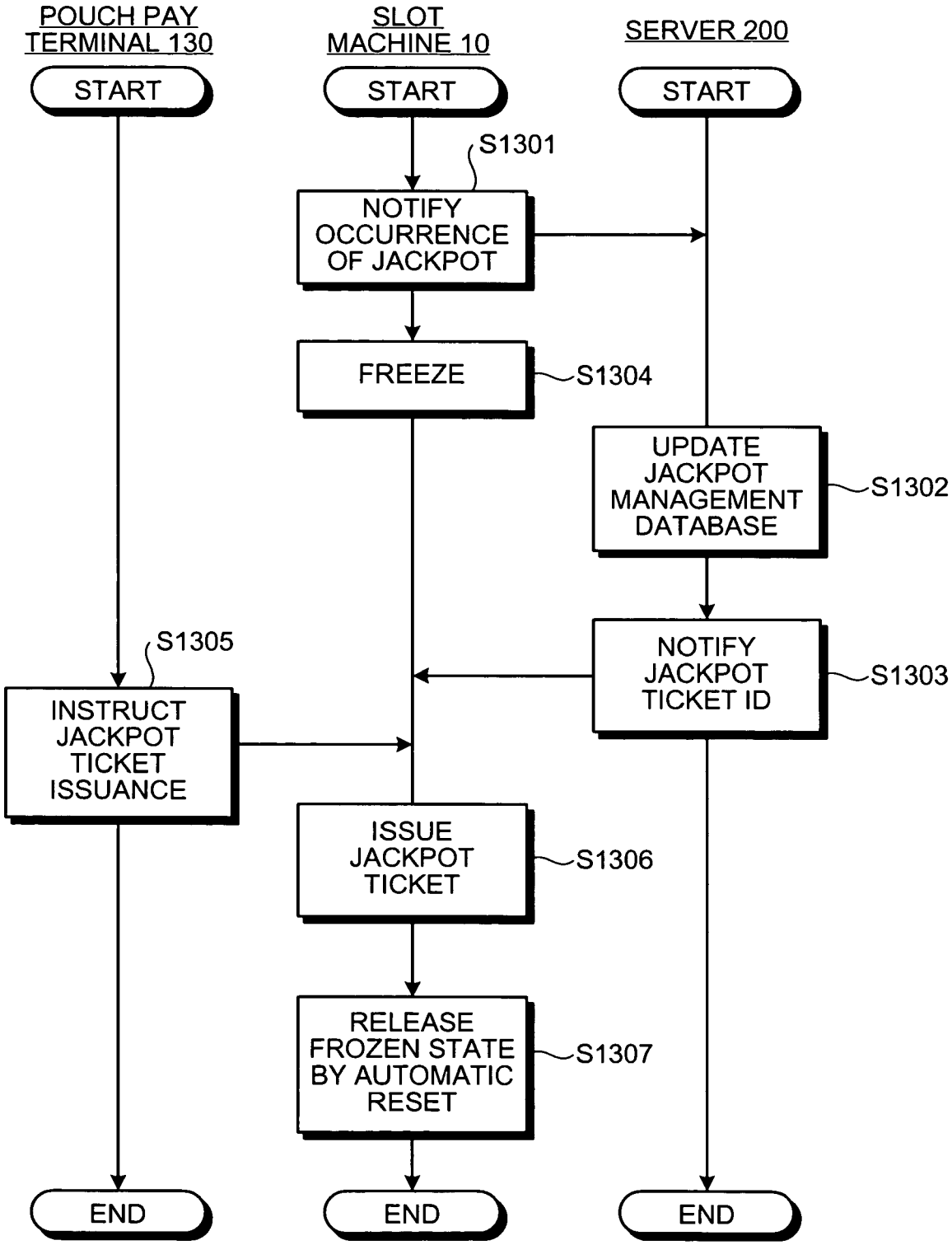
FIG. 25 is a flowchart of a jackpot ticket issuing procedure performed by the pouch pay terminal, the slot machine, and the server shown in FIG. 20.

FIG. 25 is a flowchart of a jackpot ticket issuing procedure. When a jackpot occurs at the slot machine 10, the slot machine 10 sends a notice of occurrence of the jackpot to the server 200 (Step S1301), and gets frozen so that any player cannot play a game (Step S1304). The notice includes the machine number, the date and time of occurrence, and the cash amount.

The server 200, after receiving the notice, generates a jackpot ID and updates the jackpot management database 202 (Step S1302), and sends a notice of the jackpot ID to the slot machine 10 (Step S1303).

When the pouch pay terminal 130 sends an instruction for issuing a jackpot ticket to the slot machine 10 (Step S1305), the slot machine 10 issues a jackpot ticket with a barcode printed thereon including the jackpot ID received from the server 200 (Step S1306), and then releases the frozen state with automatic reset (Step S1307).

Figure 26:
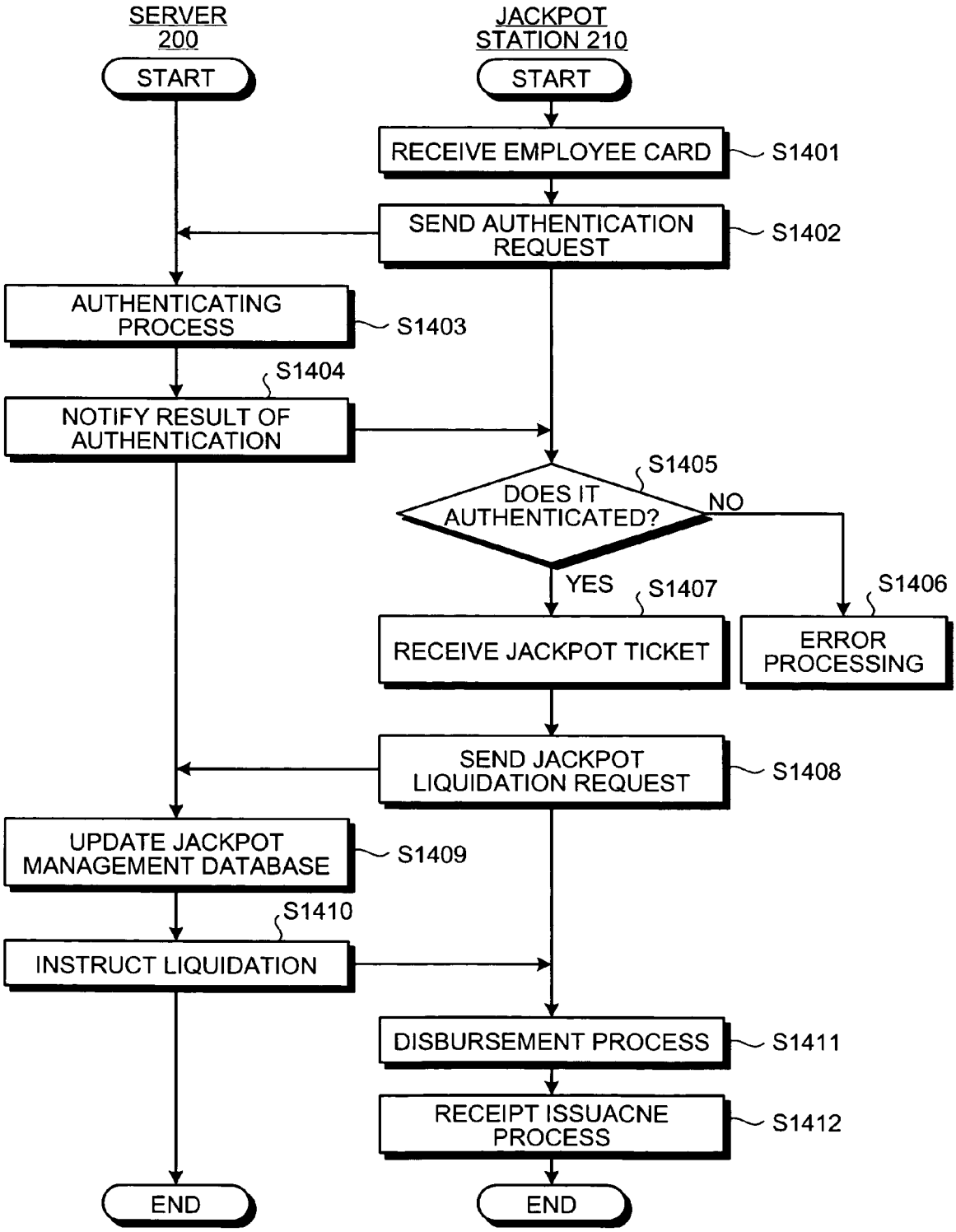
FIG. 26 is a flowchart of a jackpot liquidating procedure performed by the server and the jackpot station shown in FIG. 20.

FIG. 26 is a flowchart of a jackpot liquidating procedure. As shown in FIG. 26, the jackpot station 210, after receiving an employee card (Step S1401), requests authentication by sending an employee ID (Step S1402). Information concerning the request for authentication may include a security code with the employee ID. In such case the employee should input the security code.

The server 200, after receiving the authentication request, performs an employee-authenticating process (Step S1403), and returns a result of authentication to the jackpot station 210 (Step S1404). When the employee is not authenticated (NO at Step S1405), the jackpot station 210 performs error processing (Step S1406). When the employee is authenticated (YES at Step S1405), the jackpot station 210 receives the jackpot ticket (Step S1407), obtains a jackpot ticket ID by reading from a barcode printed on the jackpot ticket, and requests liquidation of the jackpot by sending the jackpot ticket ID to the server 200 (Step S1408).

The server 200, after receiving the liquidation request, updates a state assigned to the jackpot ticket ID to "liquidated" (Step S1409), and sends an instruction for liquidation to the jackpot station 210 (Step S1410).

The jackpot station 210, after receiving the liquidation instruction, disburses the liquidated amount (Step S1411), and also issues a receipt and a tax practice application card (Step S1412).

Although the jackpot ticket is issued to identify a jackpot in the second example of the second embodiment described above, the pouch pay terminal 130 may be used instead of issuing the jackpot ticket.

Figure 27:
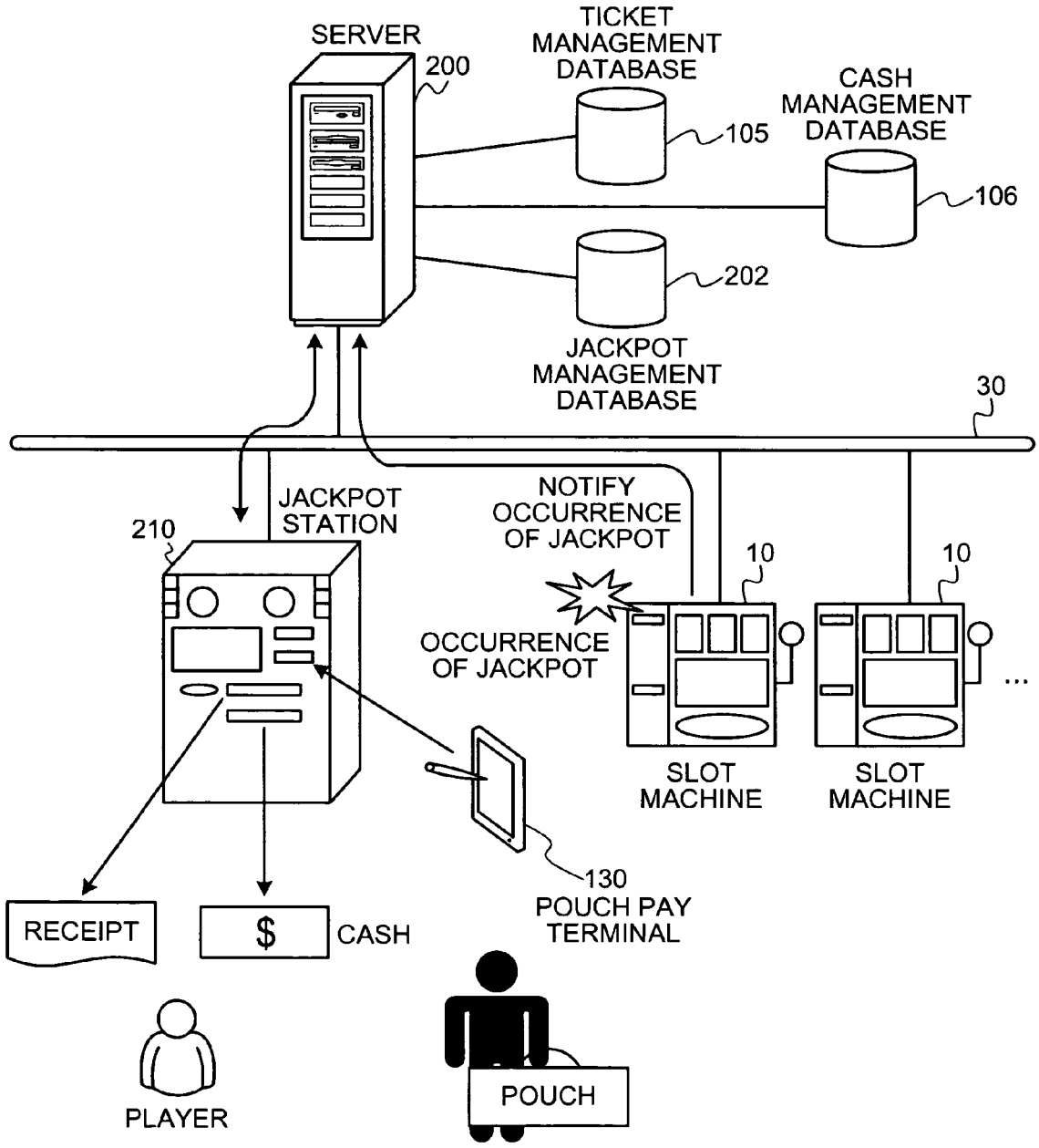
FIG. 27 is a schematic for explaining how the jackpot is identified at a pouch pay terminal.

FIG. 27 is a schematic for explaining how the jackpot is identified at the pouch pay terminal 130. FIG. 27 illustrates a case in which the pouch pay terminal 130 is used for identifying a jackpot being subject to liquidation by the jackpot station 210.

Figure 28:
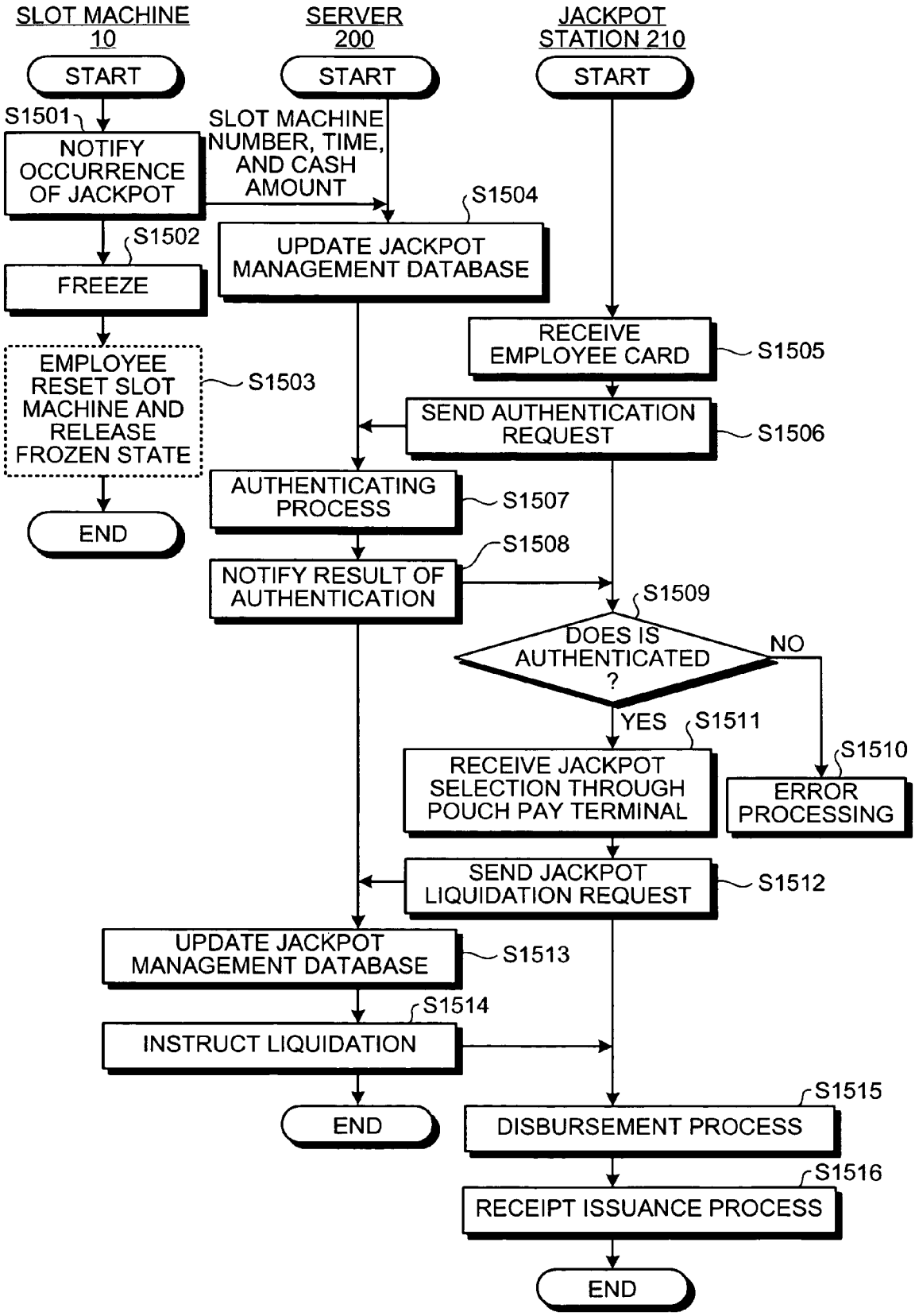
FIG. 28 is a flowchart of the jackpot liquidating procedure performed by the slot machine, the server, and the jackpot station shown in FIG. 20.

FIG. 28 is a flowchart of the jackpot liquidating procedure while identifying the jackpot with the pouch pay terminal 130. As shown in FIG. 28, when a jackpot occurs at the slot machine 10, the slot machine 10 sends a notice of occurrence of the jackpot to the server 200 (Step S1501). The notice includes the machine number of the slot machine 10, the date and time of occurrence, and the cash amount for the jackpot. After Step S1501, the slot machine 10 gets frozen (Step S1502). The frozen state is released when reset by the employee (Step S1503). The employee, after performs the reset process, comes to the jackpot station 210 together with the player and a supervisor.

The server 200, after receiving the notice of occurrence of the jackpot, generates the jackpot ID and registers information on the jackpot management database 202 such as the machine number of the slot machine 10, the date and time of occurrence, and the cash amount for the jackpot together with the jackpot ID (Step S1504).

The jackpot station 210, after receiving the employee card (Step S1505), sends an employee-authentication request by sending an employee ID to the server 200 (Step S1506). Information for the authentication request may include a security code with the employee ID. In such case the employee should input the security code.

The server 200, after receiving the employee-authentication request, performs an authenticating process for the employee (Step S1507), and returns a result of authentication to the jackpot station 210 (Step S1508). When the employee is not authenticated (NO at Step S1509), the jackpot station 210 performs error processing (Step S1510). When the employee is authenticated (YES at Step S1509), the jackpot station 210 receives selection of a jackpot being subjected to the liquidation using the pouch pay terminal 130 (Step S1511), and sends a request for liquidation of the jackpot to be selected to the server 200 (Step S1512).

The server 200, after receiving the liquidation request, updates a state assigned to the jackpot ID to "liquidated" on the jackpot management database 202 (Step S1513) and sends an instruction for liquidation to the jackpot station 210 (Step S1514).

The jackpot station 210, after receiving the liquidation instruction, disburses the liquidation amount (Step S1515) and issues a receipt and a tax practice application card (Step S1516). Information for the tax practice application card should be input at the pouch pay terminal 130 and sent to the server 200.

A membership management function may be added to the server 100 shown in the first embodiment as well as to the server 200 shown in the second embodiment described above. In such case, once information of an address and a name required to issue a tax practice application card is input, it is not required to input the information again. Comparing to the system without the membership management function where the information is input at each time of occurrence of a jackpot, the system with the membership management function can performs the process effectively and speedily.

Furthermore, a player can select a type of cash output from the ticket liquidation machine 110 described above in the first embodiment. For instance, when a disbursement amount is 100 dollars, the ticket liquidation machine 110 dispenses either one hundred-dollar bill or ten notes of ten-dollar bill. When a membership card is inserted into the ticket liquidation machine 110, the ticket liquidation machine 110 can give a reward for the member as adding some points whose number may be changed depending on liquidation amount, type of game, and date of play. Besides, a message for the member who inserts a membership card can be displayed. When the member consumes the point, a receipt containing the number of consumed points may be issued.

Also, the ticket liquidation machine 110 may be configured to promote a player to donate a part of disbursement amount. When, for instance, coins and bills are dispensed from the ticket liquidation machine 110 as the disbursement amount, the cash amount corresponding to the coins is donated automatically when the player wishes to do. Besides, the ticket liquidation machine 110 may remit the disbursement amount to a player's bank account instead of dispensing cash, though the embodiments above are described on the assumption that cash is dispensed. In addition, light intensity or type of indication by the state indicator lamp in the ticket liquidation machine 110 may be varied according to the liquidation amount.

When two ticket liquidation machines 110 (Machine 1 and Machine 2) are operating, a cash amount in each of the ticket liquidation machines is managed by directly communicating each other or via a server. To balance a cash amount in one ticket liquidation machine 110 with that in the other, following operations may be performed. Namely, (1) when the cash amount in Machine 1 is less than that in Machine 2 by a prespecified amount, Machine 1 is switched to a suspended state and liquidation is performed only by Machine 2, and (2) when cash amount in Machine 1 is nearly equal to that in Machine 2, Machine 1 is switched to an operating state.

Some users or functions may be restricted depending on the cash amount in the ticket liquidation machine 110. For instance, when the cash amount in the ticket liquidation machine 110 is short, the ticket liquidation machine may reject an operation by the person responsible for the pouch pay. Similarly, the jackpot station 210 with functions of the ticket liquidation machine may reject an operation for a jackpot but only receive the ticket liquidation when the cash amount in the jackpot station 210 is short.

The ticket liquidation machine 110 may dispense a disbursement amount by automatically exchanging the full of or a part of the amount for small bills when a player liquidates the ticket at the ticket liquidation machine 110. For instance, when the player puts the ticket with a ticket remaining amount of 100 dollars into the ticket liquidation machine 110, the ticket liquidation machine 110 may dispense nine notes of ten-dollar bill and ten notes of one-dollar bill ($100=$10×9+$1×10) instead of one note of one hundred-dollar bill. Similarly, when the player puts the ticket with a ticket remaining amount of 125 dollars, the ticket liquidation machine 110 may dispense eleven notes of ten-dollar bill, one note of five-dollar bill, and five notes of one-dollar bill ($125=$10×11+$5×2+$1×5). When the player puts the ticket with a ticket remaining amount of 20 dollars, the ticket liquidation machine 110 may dispense three notes of five-dollar bill and five notes of one-dollar bill ($20=$5×3+$1×5). When the player puts the ticket with a ticket remaining amount of 40 dollars, the ticket liquidation machine 110 may dispense one note of twenty-dollar bill, three notes of five-dollar bill, and five notes of one-dollar bill ($40=$20×1+$5×3+$1×5).

As described above, the ticket liquidation machine 110 is able to dispense a disbursement amount in various combinations of cash types by exchanging the full of or a part of the amount for small bills. The type of combination is set on the server 40. When a manager of a casino operates the server 40 to enable or disable an automatic exchanging function of the ticket liquidation machine 110, the setting information is sent from the server 40 to each ticket liquidation machine 110 in batch. The server 40 sets types of target bills to be exchanged such as the one hundred-dollar bill and the twenty-dollar bill, and money-exchanging mode, for instance classifying the cases based on a total amount of ticket liquidation (X) into (1) X is 100 dollars or more (X=$100), (2) X is 20 dollars or more and less than 100 dollars ($20=X<$100) (3) X is less than 20 dollars (X<$20).

Other effects and variations may be anticipated by those in the art. The present invention is not limited to the embodiments described above. Therefore, various changes and modifications are receivable within a scope of the present invention as defined in the attached claims or the equivalents.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A recording medium management system comprising:

a playing machine that issues a recording medium with a unique recording medium identifying information in response to an operation for issuing the recording medium;

a managing unit that manages a remaining amount of a value assigned to each recording medium for each recording medium identifying information;

a recording medium liquidation device that receives the recording medium, acquires the recording medium identifying information from the recording medium, sends an inquiry to the managing unit concerning a remaining amount of a value assigned to the information for identifying recording medium read from the recording medium, and dispenses cash corresponding to the remaining amount returned from the managing unit;

a pouch pay terminal device that is carried by a person walking around in a shop and providing a liquidation service for a recording medium to players, acquires recording medium identifying information from a recording medium received from a player, sends an inquiry to the managing unit concerning a remaining amount of a value assigned to the recording medium identifying information read from the recording medium, and displays a remaining amount returned from the managing unit; and a cashier terminal device that is provided at a cashier counter providing processing relating to cash for each recording medium with help by a person in charge for the cashier counter, acquires recording medium identifying information from a recording medium received from a player, sends an inquiry to the managing unit concerning a remaining amount of a value assigned to the recording medium identifying information read from the recording medium, and displays a remaining amount returned from the managing unit, wherein the managing unit includes a recording medium management database that manages, for each recording medium identifying information, a state of a liquidated recording medium having been subjected to liquidation by any one of the recording medium liquidation device, the pouch pay terminal device, and the cashier terminal device as well as a recording medium not having been subjected to liquidation; and a state updating unit that updates a state of each recording medium managed in the recording medium management database based on recording medium identifying information received from any one of the playing machine, the recording medium liquidation device, the pouch pay terminal device, and the cashier terminal device.

2. The recording medium management system according to claim 1, wherein issuance information comprising data and time of issuance of each recording medium, a machine number of a machine issuing the recording medium, and a remaining amount, and state information concerning classification of a state of the recording medium and a location of the recording medium are managed corresponding to recording medium identifying information in the recording medium management database.

3. The recording medium management system according to claim 2, wherein the managing unit further includes a recording medium identifying information generating unit that generates, when receiving a request for issuance of a recording medium from the playing machine, the recording medium identifying information;

a recording medium identification notifying unit that notifies the recording medium identifying information generated by the recording medium identifying information generating unit to the playing machine; and a registering unit that registers the recording medium identifying information generated by the recording medium identifying information generating unit corresponding to the issuance information as well as to the state information indicating a classification of the state of the recording medium in the recording medium management database.

4. The recording medium management system according to claim 3, wherein the managing unit further includes an updating unit that updates, when recording medium identifying information is received from the recording medium liquidation device, a classification of the state information in the recording medium management database corresponding to the recording medium identifying information to "recording medium liquidation device".

5. The recording medium management system according to claim 3, wherein the managing unit further includes an updating unit that updates, when recording medium identifying information received from the recording medium liquidation device and concerning a recording medium to be recovered is registered in the recording medium management database, a classification of the state information for the recording medium identifying information to "recovering".

6. The recording medium management system according to claim 3, wherein the managing unit further includes an updating unit that updates, when recording medium identifying information is received from the cashier terminal device, a classification of the state information corresponding to the recording medium identifying information and stored in the recording medium management database to "cashier counter".

7. The recording medium management system according to claim 3, wherein the managing unit further includes an updating unit that updates, when a classification of the state information for the recording medium identifying information received from the cashier terminal device is pouch pay, a classification corresponding to the recording medium identifying information and stored in the recording medium management database from "pouch payer" to "cashier counter".

8. The recording medium management system according to claim 3, wherein the managing unit further includes an updating unit that updates, when recording medium identifying information is received from the pouch pay terminal device, a classification of the state information corresponding to the recording medium identifying information and stored in the recording medium management database to "pouch payer".

9. The recording medium management system according to claim 8, wherein the recording medium liquidation device includes an updating unit that accommodates, when a classification of the state information for an received recording medium is "pouch payer", the recording medium and dispenses cash corresponding to a remaining amount with the value stored in the recording medium, and the managing unit further includes an updating unit that updates, when recording medium identifying information is received from the recording medium liquidation device, a classification of the state information corresponding to the recording medium identifying information and stored in the recording medium management database from "pouch payer" to "ticket liquidation machine".

10. The recording medium management system according to claim 3, wherein the managing unit further includes an updating unit that updates, when recording medium identifying information is received from the playing machine, a classification of the state information corresponding to the recording medium identifying information and stored in the recording medium management database to "playing machine".

11. The recording medium management system according to claim 3, further comprising a counting machine that counts at least one of a recording media and cash having been subjected to liquidation by any one of the recording medium liquidation device, the pouch pay terminal device, and the cashier terminal device, wherein the managing unit further includes an updating unit that updates, when recording medium identifying information is received from the counting machine, a classification of the state information corresponding to the recording medium identifying information and stored in the recording medium management database to "recovered".

12. The recording medium management system according to claim 1, wherein the managing unit further includes a cash management database that manages cash accommodated in the recording medium liquidation device and cash held by the person or cashier at the cashier counter; and a cash management database updating unit that updates the cash management database in response to liquidation by the person or the cashier.

13. The recording medium management system according to claim 12, further comprising a reserve disbursing unit that disburses reserve initially held by the person, wherein the cash management database updating unit updates the cash management database in response to disbursement of reserve for pouch pay by the recording medium liquidation device.

14. The recording medium management system according to claim 1, wherein the managing unit further includes a jackpot database that manages a date and time of generation of a jackpot generated in the playing machine, a machine number of and an amount of jackpot in the playing machine in correspondence to a jackpot ID, and the recording medium liquidation device liquidates a jackpot as an object for liquidation based on the jackpot database managed by the managing unit.

15. The recording medium management system according to claim 14, wherein the recording medium liquidation device issues a receipt and a tax practice declaration card when the jackpot is liquidated.

16. The recording medium management system according to claim 14, wherein the playing machine includes a recording medium issuing unit for a jackpot that issues a recording medium for a jackpot uniquely identifying, when a jackpot occurs, the jackpot, and the recording medium liquidation device liquidates a jackpot as an object for liquidation based on the jackpot database managed by the managing unit as well as on the recording medium for a jackpot issued by the recording medium issuing unit for a jackpot.

17. The recording medium management system according to claim 14, wherein the recording medium liquidation device liquidates a jackpot specified at the pouch pay terminal device among those registered in the jackpot database managed by the managing unit.

18. The recording medium management system according to claim 1, wherein the managing unit further includes an illegality detecting unit that checks for any illegality, when recording medium identifying information is received from any one of the recording medium liquidation device, the pouch pay terminal device, and the cashier terminal device, based on a state of the recording medium corresponding to the recording medium identifying information managed in the recording medium management database; and a reporting unit that reports, when the illegality detecting unit detects illegality, the fact that the illegality has been detected.

19. A recording medium liquidation device comprising:

a reading unit that reads, when receiving a recording medium issued from a playing machine and used for management of a remaining amount stored therein by a managing unit, recording medium identifying information in the recording medium;

a remaining amount inquiring unit that sends an inquiry concerning a remaining amount correlated to the identifying information read by the reading unit to the managing unit;

a liquidating unit that performs liquidation by dispensing cash corresponding to a remaining amount returned from the managing unit in response to the inquiry from the remaining amount inquiring unit;

a reserve disbursing unit that disburses reserve to be delivered to a person walking around in a shop and performing a liquidation service for a recording medium to a player; and a secondary liquidating unit that receives a recording medium having been subjected to liquidation by the person and executes secondary liquidation by dispensing cash correlated to a value stored in the recording medium.

20. The recording medium liquidation device according to claim 19, further comprising an operation receiving unit that receives an operation for switching to the employee mode performed by an employee working in a play shop, wherein the secondary liquidating unit performs secondary liquidation by receiving a recording medium having been subjected to liquidation performed by the person and dispensing cash correlated to a value stored in the recording medium when an operating mode is switched by the operation receiving unit from a normal mode to the employee mode and does not perform the secondary liquidation in the normal mode.

21. The recording medium liquidation device according to claim 19, further comprising a jackpot liquidating unit that liquidates a jackpot generated in the playing machine; and an issuing unit that issues a receipt and a tax practice application card when liquidation of the jackpot is performed by the jackpot liquidating unit.

22. The recording medium liquidation device according to claim 19, wherein the jackpot liquidating unit identifies, when a recording medium for a jackpot storing therein jackpot identifying information uniquely identifying the jackpot issued from the playing machine is received, the jackpot as an object for liquidation, among those generated in the playing machine, based on the jackpot identifying information and performs liquidation for the identified jackpot.

* * * * *